US006497476B1

(12) United States Patent
Namba et al.

(10) Patent No.: US 6,497,476 B1
(45) Date of Patent: Dec. 24, 2002

(54) LIQUID INJECTION DEVICE, MANUFACTURING METHOD THEREFOR, LIQUID INJECTION METHOD AND MANUFACTURING METHOD FOR PIEZO-ELECTRIC ACTUATOR

(75) Inventors: Akihiko Namba, Osaka (JP); Masayuki Okano, Moriguchi (JP); Atsushi Komatsu, Katano (JP); Yosihiro Tomita, Osaka (JP); Osamu Kawasaki, Kyotanabe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/412,971

(22) Filed: Oct. 6, 1999

(30) Foreign Application Priority Data

Oct. 12, 1998 (JP) ..... 10-289851
Dec. 17, 1998 (JP) ..... 10-359698

(51) Int. Cl.[7] ..... B41J 2/045
(52) U.S. Cl. ..... 347/68
(58) Field of Search ..... 347/68, 65, 67, 347/71, 72

(56) References Cited

U.S. PATENT DOCUMENTS 5,563,634 A * 10/1996 Fujii et al. ..... 347/9
5,784,085 A * 7/1998 Hosono et al. ..... 347/70
5,793,149 A 8/1998 Thiel et al. ..... 310/328
6,270,202 B1 * 8/2001 Namba et al. ..... 347/68

FOREIGN PATENT DOCUMENTS

| | | |
|---|---|---|
| EP | 0207568 | 1/1987 |
| EP | 0337429 | 10/1989 |
| EP | 0655333 | 5/1995 |
| EP | 0709195 | 5/1996 |
| EP | 0782923 | 7/1997 |

* cited by examiner

*Primary Examiner*—Thinh Nguyen
(74) *Attorney, Agent, or Firm*—Smith, Gambrell & Russell, LLP

(57) ABSTRACT

A liquid injection device has a liquid pressurizing chamber having one or a plurality of apertures, a liquid injection port provided at a part of the liquid pressurizing chamber, a liquid pressurizing member arranged adjacent to the liquid pressurizing chamber, a liquid passage arranged adjacent to the liquid pressurizing chamber; wherein within the aperture(s), a peripheral edge portion of the aperture(s) located at a position opposite to the liquid pressurizing member and the liquid pressurizing member are arranged to be apart from each other at a gap with a predetermined size; further wherein liquid is injected through the liquid injection port by driving the liquid pressurizing member to thereby pressurize the liquid supplied from the liquid passage into the liquid pressurizing chamber.

29 Claims, 31 Drawing Sheets

(a)

(b)

(c)

(d)

(e)

(f)

LIQUID INJECTION DEVICE, MANUFACTURING METHOD THEREFOR, LIQUID INJECTION METHOD AND MANUFACTURING METHOD FOR PIEZO-ELECTRIC ACTUATOR

BACKGROUND OF THE INVENTION

1. Field of the Invention

The present invention relates to a liquid injection device or the like used for an ink jet printer or the like.

2. Related Art of the Invention

In recent years, ink jet printers have been rapidly becoming popular as a printer capable of implementing color printing at low price. It is an ink injection device that determines the performance of this ink jet printer, and it is a liquid injection device which intermittently injects fine liquid particles.

As a conventional liquid injection device, the description will be made by exemplifying a typical ink injection device for ink jet printers. The ink injection device for ink jet printers can be generally classified under the following two types: heat type and piezo-electric type.

The injection principle of the typical heat type will be described with reference to FIG. 24. FIG. 24 is a cross-sectional view showing an ink injection element constituting an ink injection device. An ink pressurizing chamber 803 is provided in space interposed between a substrate 801 and a substrate 802, and a heater 804 is provided between the ink pressurizing chamber 803 and the substrate 801. Ink is supplied from an ink storage (not shown) provided outside of the ink injection element by a capillary phenomenon or a suction operation from outside, and is supplied to the ink pressurizing chamber 803 through an ink passage 806. When the heater 804 is electrically energized in this state, the ink intensely boils to generate air bubbles. The growth of these air bubbles increases the pressure within the ink pressurizing chamber 803 to inject the ink through an ink injection port 806. An actual ink injection device is configured by a plurality of ink injection elements described above lined.

Next, an example of a typical piezo-electric type ink injection device for ink jet printers will be described with reference to FIG. 25, which is a cross-sectional view for an ink injection element. In FIG. 25, a reference numeral 813 denotes a piezo-electric actuator, which is driven by a piezo-electric operation, and is, for example, a bimorph element configured by two piezo-electric elements, or an unimorph element configured by a piezo-electric element and a diaphragm, or the like. A reference numeral 818 denotes an ink passage; 819, an ink pressurizing chamber; and 820, an ink injection port. A portion indicated by broken lines in the piezo-electric actuator 813 schematically shows deformation of the piezo-electric actuator. Ink is supplied from an ink storage (not shown) provided outside of the ink injection element at the beginning by a capillary phenomenon or a suction operation from outside, and is supplied to the ink pressurizing chamber 819 through the ink passage 818. When the piezo-electric actuator 813 is caused to become deformed as indicated by the broken lines in a state in which the ink passage 818 and the ink pressurizing chamber 819 are filled with the ink, the pressure within the ink pressurizing chamber 819 increases to inject the ink through the ink injection port 820. The actual ink injection device is constructed such that a plurality of elements described above are arranged in a line because of high-speed printing.

In recent years, requests for an ink jet printer capable of expressing more colorful colors at low price have been increasing, and in order to perform more colorful color printing by an ink jet printer using such a liquid injection device, it is necessary to increase a number of gradation levels perunitpicture element (pixel), that is, to implement multi-tone printing.

A method for implementing such multi-tone printing will be described below.

First, a method using an area modulation system is named. This method is to form an unit picture element (pixel) for expressing light and dark density by hitting a plurality of dots without superimposing one on another, and to express the gradation by changing a rate of ink per unit picture element.

Secondly, a method using superposedly dotting is named. This method is to inject ink on the same place a plurality of times and to express the gradation by changing the size of unit pixel.

Thirdly, a method using a density modulation system is named. This method is to express the gradation by using a plurality of inks of different coloring matter density.

Fourthly, a method using a dot modulation system is named. This method is to discharge ink drops having different sizes through the same injection port, and is capable of change the size of dot for each injection.

However, the above-described methods for implementing multi-tone printing have the following problems respectively.

First, problems of the area modulation system will be described. In the area modulation system, since dots to be recorded are thinned out to express light and dark density, the size of the unit pixel required to express the light and dark density becomes large to lower actual recording density. Therefore, when an attempt is made to express multi-tone light and dark density, print with conspicuous surface roughness in a low-density portion is produced. In order to reduce the lowered recording density, the size of the unit pixel is made as small as possible. In other words, it becomes necessary to make the minimum dot diameter smaller. In order to reduce the minimum dot diameter, or to discharge small ink drops, it is necessary to reduce the injection port diameter or to device the discharging method. Since, however, the conventional injection port diameter of the ink jet head is as small as 20 to about 30 microns, in order to bore an injection port with a smaller diameter than the injection port diameter, a more difficult manufacturing process is required and yet more injection ports must be provided, leading to an increase in manufacturing cost. Also, in such smaller injection ports, ink clogging or defective discharging due to dust or the like mixed into the ink is prone to occur, possibly deteriorating the reliability of the products. Also, even if the above-described problem was solved and ink drops having small dot diameter could be injected, a problem that the printing speed becomes slower would occur. This is a problem which occurs when more ink drops must be discharged in order to fill in the same area, and in order to solve this problem, there become necessary devices such as (1) to shorten discharge repeating time (high-speed driving of the ink injection device) and (2) to increase the number of elements (number of injection ports) The former (1) is difficult because of rate-determining of heat transmission time in the case of the heat type ink injection device. In the case of the piezo-electric type ink injection device, it may be driven at high speed as compared with the heat type, but there is a limit because of the trackability of the liquid to the piezo-electric actuator, and the like. Also, the latter (2) causes problems such as complicated device and reduced yields in the manufacture, leading to an increase in cost.

Secondly, as regards the method using superposedly dotting, the generally same problem occurs as the problem in the area modulation system because a multiplicity of smaller dots than the unit pixel must be hit in the unit pixel. Further, since liquid is shot onto the same point intensively in addition, a granulation phenomenon is prone to occur, easily causing print with surface roughness feeling.

Thirdly, the problem of density modulation system will be described. In the density modulation system, it is necessary to have a plurality of inks of different coloring matter density, and there arises a problem that the device becomes complicated and larger, and the cost is increased. Also, with an increase in type of the ink, there arise problems that the number of elements which can be actually used also reduces (number of elements/type of ink) and the printing speed is slowed down.

Fourthly, problems of the dot modulation system will be described. The dot modulation system modulates the dot diameter by directly changing an injected amount to be injected at a time, and therefore, the above-described problem in the three types of modulation systems is greatly reduced. For example, since the unit pixel comprises one dot, light and dark expression can be made without causing any increase in the unit pixel size. Also, since it is not necessary to hit a multiplicity of dots on the unit pixel, it is possible to perform high-speed printing without necessitating any increase in the number of injection ports.

In the foregoing, of the conventional techniques for implementing the multi-tone printing, the fourth dot modulation system is most excellent.

In the conventional ink injection device, however, the dot modulation system itself, that is, to modulate the dot by injecting liquid drops having different diameters through the same liquid injection device is very difficult.

In the conventional heat type ink injection device, since ink is injected using an intense boiling phenomenon, it is very difficult to control, and in a printer using this ink injection device, there is used two-valued control as to whether ink is injected or not injected. Therefore, light and dark expression is normally performed by the area modulation system, or the density modulation system or by a combination of both, and there are such problems as described above.

In the conventional piezo-electric type, it is possible, unlike the heat type, to control an amount of ink to be injected to some degree by controlling the displacement amount of the piezo-electric actuator. As matters now stand, however, the number of gradation levels is as insufficient as two to about six, and the modulation width is as insufficient as about two. The modulation width is, however, defined as a ratio of a minimum amount of ink injected (volume) to a maximum amount (volume) of ink injected. Originally, it should be defined as a ratio of diameters of dots recorded, but it has been defined as described above because the dot diameter greatly changes depending upon the physical properties of the ink and paper. Therefore, even in the conventional piezo-electric type, on expressing the gradation, light and dark expression is normally performed by the area modulation system, or the density modulation system or by a combination of both, and there are such problems as described above.

In the piezo-electric type liquid injection device, conditions on implementing the dot modulation and problems in the existing condition will be further described in detail.

In order to implement the dot modulation, it is first necessary to enlarge the width of energy amount which can be supplied to the liquid to be injected. This is a condition required to make the modulation width large because the necessary energy amount differs depending upon the amount of liquid drops to be injected. Normally, the rate is determined by its upper limit value, but it is necessary to improve the energy utilization efficiency of the device because there is a limit to the amount of energy which can be supplied to the device. Secondly, in order to inject large liquid drops, it is necessary to arrange the structure such that the displacement amount of the piezo-electric actuator can be taken large (large displacement properties). In the injection of comparatively large liquid drops, the larger the displacement amount of the piezo-electric actuator is, the larger the liquid drop diameter becomes. In other words, the liquid drop diameter can be modulated with the displacement amount as a parameter. Thirdly, in order to inject small liquid drops, it is necessary to change the pressure within the liquid pressurizing chamber from low pressure to high pressure in a very short time while reducing the displacement amount of the piezo-electric actuator (response characteristic of pressure). In this case, the liquid drop can be modulated with the rate of change in pressure within the liquid pressurizing chamber as a parameter. Fourthly, it is necessary to accurately control the above-described displacement amount of the piezo-electric actuator and the rate of change in pressure within the liquid pressurizing chamber (controllability).

In the conventional piezo-electric type liquid injection device, it is difficult to satisfy the foregoing conditions. With reference to FIG. 25, the description will be further made. When the piezo-electric actuator 813 is displaced downward (state indicated in broken lines), the pressure within the ink pressurizing chamber 819 increases. With this increase in pressure, the piezo-electric actuator 813 undergoes a reaction from the ink within the ink pressurizing chamber 819 and the displacement amount of the piezo-electric actuator 813 becomes exceedingly small as compared with the displacement amount when there is no load such as ink.

When the piezo-electric actuator 813 is displaced downward (state indicated in broken lines), the pressure within the ink pressurizing chamber 819 increases, and the pressure within the ink passage 818 also increases at the same time. In this case, of work done which has been operated on the ink by the displacement of the piezo-electric actuator 813, that is, work done supplied to the ink, work done used to increase the pressure within the ink pressurizing chamber 819 is one-half or less of the work done. The remaining energy is consumed by the increase in pressure and loss in the ink passage 818. This can be improved to some extent by thinking out the shape of the vicinity of the border between the ink passage 815 and the ink pressurizing chamber 818 so as to solve the problem (for example, a back-flow valve is provided), but this cannot fundamentally solve it, but is limited to improving the energy utilization efficiency by 10 to about 20% at most. Also, since the piezo-electric actuator 811 is normally on all sides fixed to the ink pressurizing chamber 818 to keep the ink pressurizing chamber airtight, the displacement amount is small in principle. Further, when an attempt is made to increase the amount of ink injected to make up for such small displacement amount, it is necessary to enlarge the cross-sectional area of the ink pressurizing chamber 818 having the direction of displacement of the piezo-electric actuator 811 as the direction of the normal thereto. This causes problems that the energy loss in the ink chamber will become greater, and that the above-described reaction will further become greater. For the reasons described above, the present piezo-electric type liquid injection device has a number of gradation levels of 2 to 6, and modulation width of about 8.

As a technique to increase the modulation width with the energy utilization efficiency as it is, it can be considered to take the variable width of the amplitude value of the applied voltage large, that is, to make the maximum applied voltage high. This causes the following problems. Firstly, since the present piezo-electric actuator has insufficient dielectric strength, the element life is deteriorated or the element is broken. Also, when the element is damaged, the piezo-electric actuator normally enters a short-circuited state, causing a problem also in safety. Secondly, the piezo-electric element is often subjected to a polarization process in the driving voltage applied direction, and the application of high voltage causes part of the polarization or the whole to be lost, deteriorates the characteristic properties, or causes the piezo-electric property itself to be lost in extreme cases. Also, the disappearance of the polarization leads to deteriorated element life. Thirdly, in the case of home use, an increase in applied voltage itself causes a problem in safety and cost effectiveness. Fourthly, the surrounding circuit element becomes complicated and larger, thus increasing the cost. For the above-described problems, an increase in applied voltage is not desirable in practical use.

SUMMARY OF THE INVENTION

A liquid injection device and an injection method according to the present invention solve the above-described problems, and their object is to improve the energy utilization efficiency of the liquid injection device, or to enable the actuator to be driven in large displacement, or to make the rate of change in pressure within the pressurizing chamber higher.

One aspect of the present invention is a liquid injection device, comprising:

a liquid pressurizing chamber having one or a plurality of apertures;

a liquid injection port provided at a part of said liquid pressurizing chamber;

a liquid pressurizing member arranged adjacent said liquid pressurizing chamber; and a liquid passage arranged adjacent said liquid pressurizing chamber, within said aperture, a peripheral edge portion of said aperture located at a position opposite to said liquid pressurizing member, and said liquid pressurizing member being arranged to be apart from each other at a gap with a predetermined size when said liquid pressurizing member is driving or even at a non-driving time; and liquid being injected through said liquid injection port by driving said liquid pressurizing member to thereby pressurize said liquid supplied from said liquid passage into said liquid pressurizing chamber.

Another aspect of the present invention is the liquid injection method in a liquid injection device, comprising:

a liquid pressurizing chamber having one or a plurality of apertures;

a liquid injection port provided at a part of said liquid pressurizing chamber;

a liquid pressurizing member arranged adjacent said liquid pressurizing chamber; and a liquid passage arranged adjacent said liquid pressurizing chamber, within said aperture, a peripheral edge portion of said aperture located at a position opposite to said liquid pressurizing member, and said liquid pressurizing member being arranged to be apart from each other at a gap with a predetermined size; and pressurizing the liquid within said liquid pressurizing chamber to inject said liquid through said liquid injection port by driving said liquid pressurizing member to thereby displace said liquid pressurizing member in such a direction as to change said gap between said liquid pressurizing member and the peripheral edge portion of said aperture.

Still another aspect of the present invention is a manufacturing method for an unimorph type piezo-electric actuator configured by a diaphragm and a piezo-electric substrate which are fixed at both ends or at one end, comprising the steps of: bonding said diaphragm, after it is machined into a predetermined shape, to said piezo-electric substrate; polishing said piezo-electric substrate to a predetermined thickness; and spraying, with said diaphragm as a protective substrate, fine particles onto a piezo-electric substrate portion which does not intersect said diaphragm portion, for removing.

Yet another aspect of the present invention is a manufacturing method for a liquid injection device in which a liquid pressurizing chamber and a liquid pressurizing member are separated at a gap with a predetermined size therebetween, and the interval between said liquid pressurizing chamber and said liquid pressurizing member is controlled to thereby inject said liquid, comprising the steps of: superimposing a major substrate constituting said liquid pressurizing member on a major substrate constituting said liquid pressurizing chamber; and fixing at least said major substrate constituting said liquid pressurizing member and said major substrate constituting said liquid pressurizing chamber through the use of a member such as spring material or screw material without the aid of any adhesive.

The present invention described above enables dot modulation with wide modulation width, and implements more colorful color printing with multi-tone.

Also, according to a manufacturing method for a liquid injection device of the present invention, it becomes possible to easily manufacture a liquid injection device with wide modulation width at low cost.

DESCRIPTION OF SYMBOLS

Figure 1A:
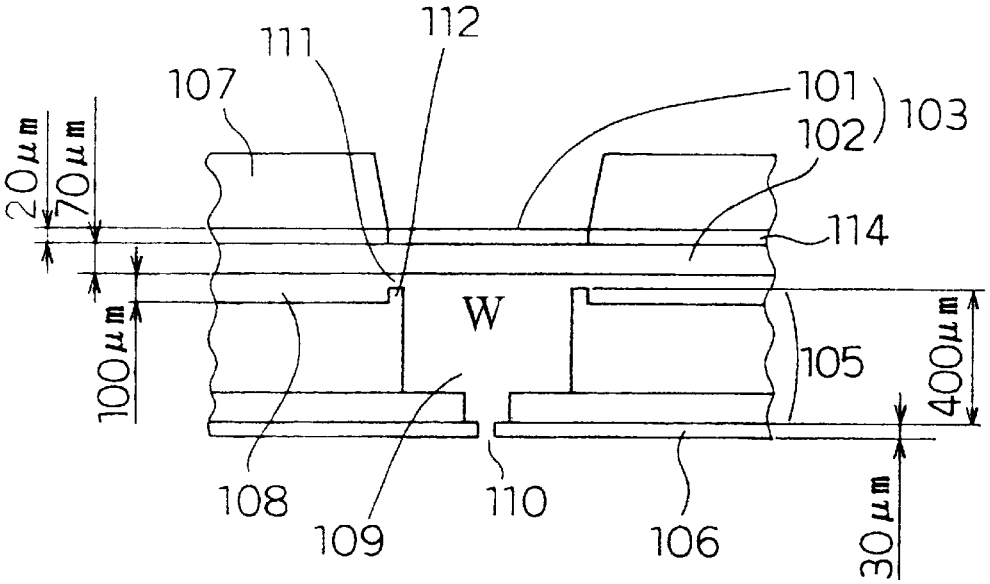
FIGS. 1(*a*)–1(*b*) is a view showing a liquid injection device according to a first embodiment of the present invention.

101 Piezo-electric ceramic substrate
102 Diaphragm
103 Piezo-electric actuator
104 Resin sheet
105 Substrate for formation of a liquid chamber
106 Substrate for formation of an injection port
107 Holding substrate
108 Liquid passage
109 Liquid pressurizing chamber
110 Liquid injection port
111 Gap
112 Partitioning portion in the liquid pressurizing chamber
114 Substrate made of stainless steel
116 High-rigidity portion
W Aperture

PREFERRED EMBODIMENTS OF THE INVENTION

First Embodiment

Figure 1B:
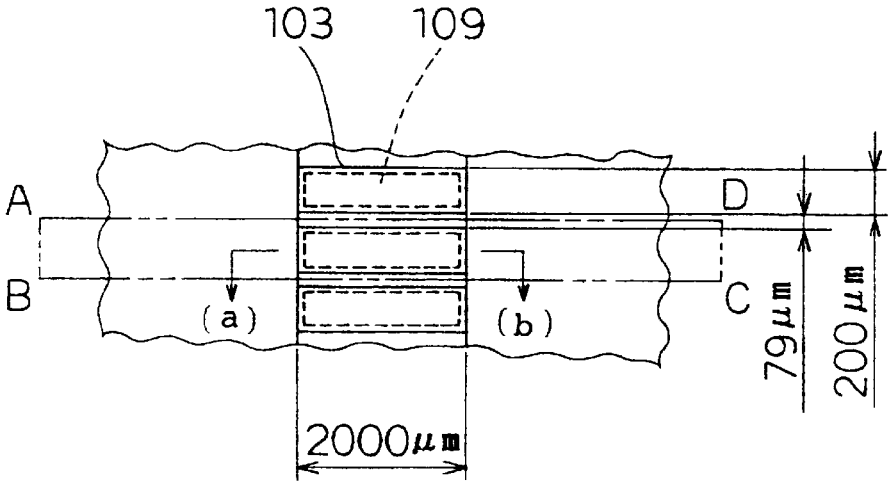
Figure 2:
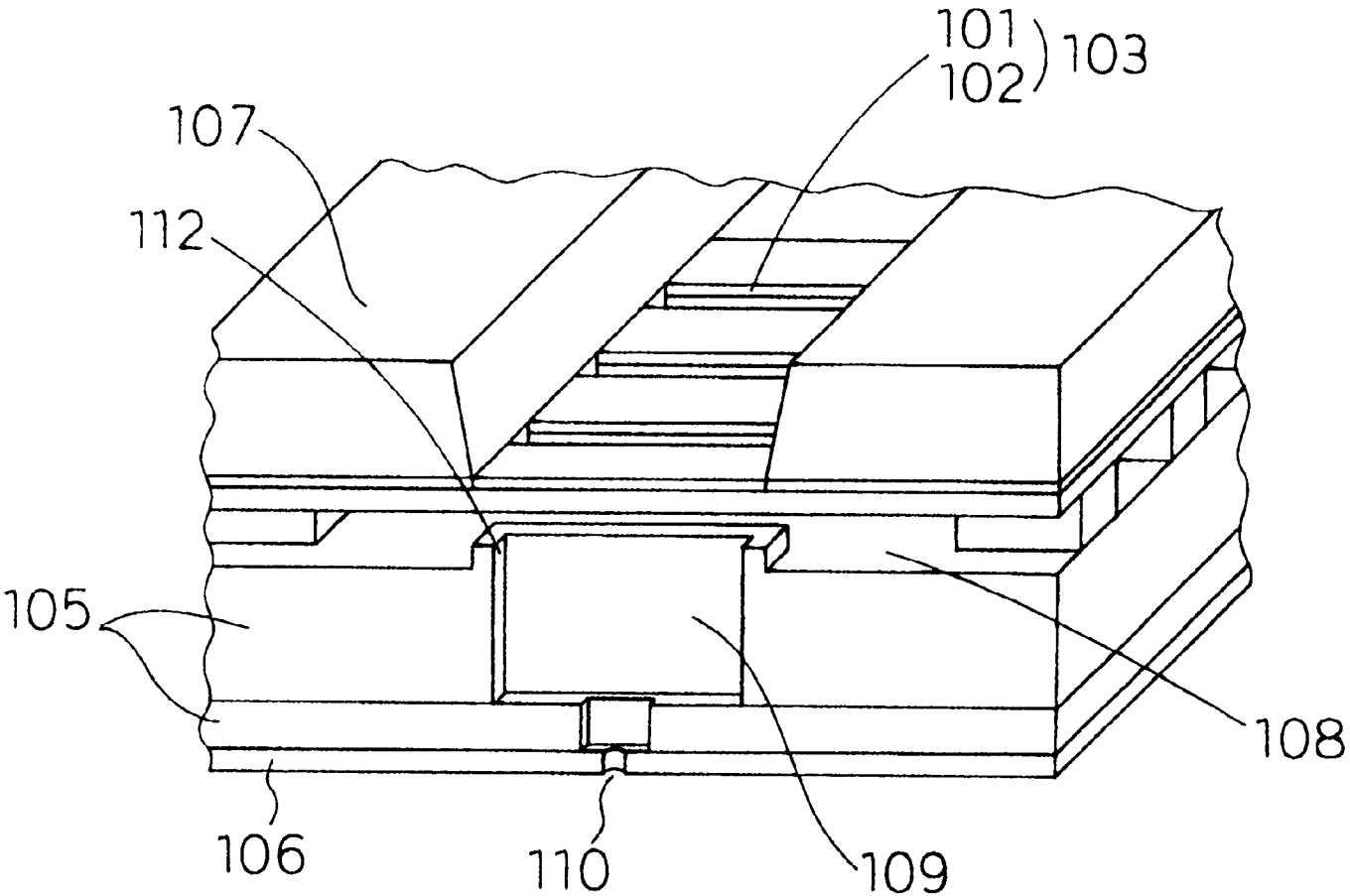
FIG. 2 is a view showing a liquid injection device according to the first embodiment of the present invention.
Figure 3B:
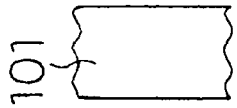
FIGS. 3(*a*)–3(*c*) is a view showing a manufacturing method for a liquid injection device according to the first embodiment of the present invention.
Figure 3A:
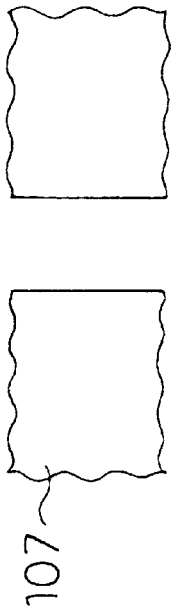
Figure 3D:
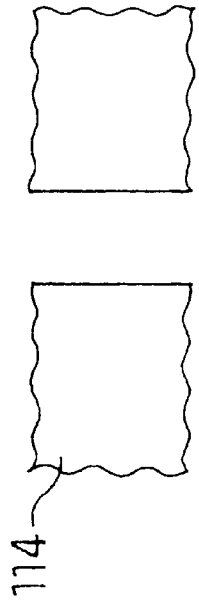
Figure 3C:
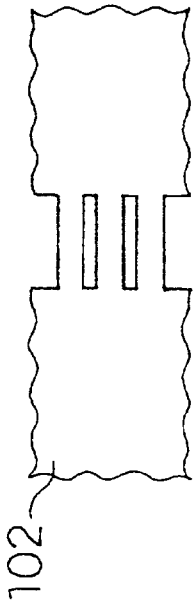
Figure 3F:
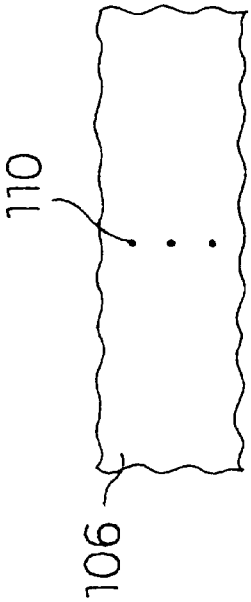
Figure 3E:
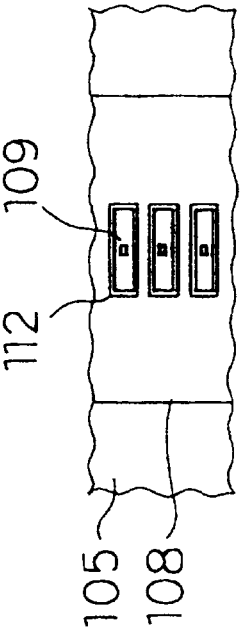
Figure 4A:
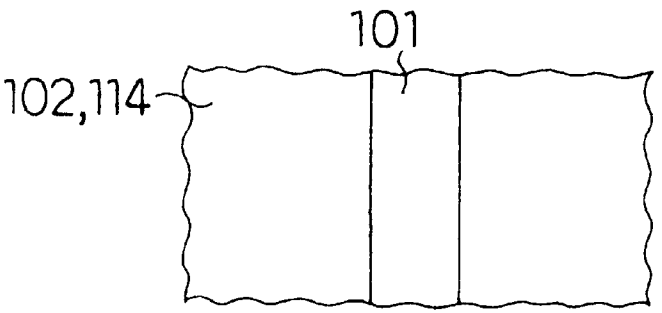
FIGS. 4(*a*)–4(*b*) is a view showing a manufacturing method for a liquid injection device according to the first embodiment of the present invention.
Figure 4B:
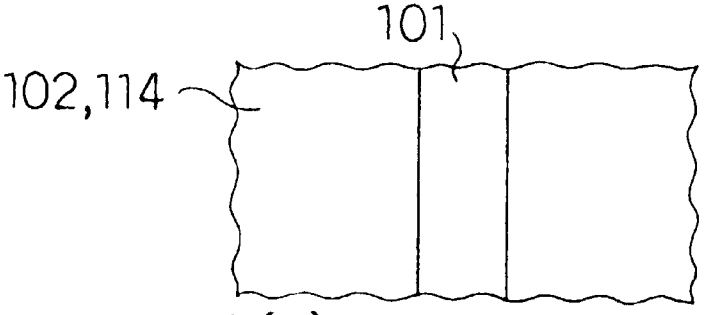
Figure 4C:
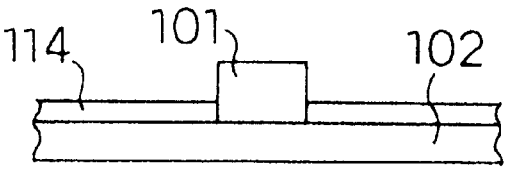
Figure 4D:
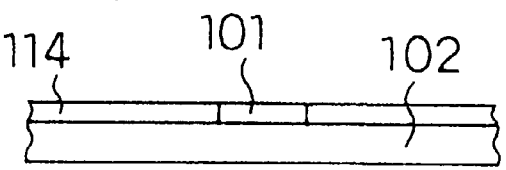
Figure 4E:
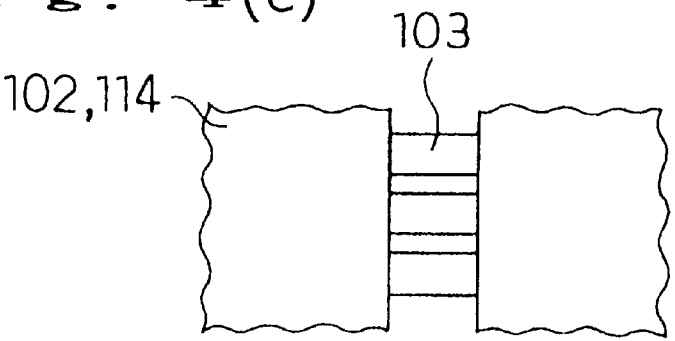

With reference to FIGS. 1 and 2, the description will be made of a first embodiment of a liquid injection device and a liquid injection method according to the present invention. FIG. 1(*a*) is a cross-sectional view showing one element of a liquid injection device according to the present embodiment, and is a cross-sectional view taken on a straight line a–b of FIG. 1(*b*). FIG. 1(*b*) is a top view representing part of a liquid injection device according to the present embodiment, and shows three liquid injection elements of the liquid injection device. The liquid injection element is, however, a portion enclosed with a two-dot chain line A-B-C-D in FIG. 1(*b*), and the liquid injection device is a device comprising a plurality of such liquid injection elements lined. FIG. 2 is a perspective view for the liquid injection device. In this respect, this liquid injection element sufficiently functions even in a single unit, and the liquid injection device can be also configured by a single liquid injection element. In FIGS. 1 and 2, a reference numeral 101 denotes a piezo-electric ceramic substrate. A reference numeral 102 denotes a diaphragm, and is a diaphragm made of, for example, stainless steel. A reference numeral 103 denotes an unimorph type piezo-electric actuator configured by the piezo-electric substrate 101 and the diaphragm 102. However, although not shown in the figures, on the piezo-electric ceramic substrate 101, an electrode for excitation is provided almost over the entire piezo-electric ceramic substrate 101. A reference numeral 105 denotes a substrate for formation of a liquid chamber mainly forming a liquid passage 108 and a liquid pressurizing chamber 109, and is, a substrate made of, for example, stainless steel. A reference numeral 106 denotes a substrate for formation of an injection port which forms an injection port 110, and is, for example, a substrate made of nickel formed by electroforming. A reference numeral 107 denotes a holding substrate for holding the actuator 103, and is, for example, a substrate made of stainless steel. A reference numeral 108 denotes a liquid passage as described above, and its part or the whole is normally filled with the liquid. Also, the liquid passages are arranged on the lateral sides of the liquid pressurizing chamber 109. The reference numeral 109 denotes the liquid pressurizing chamber as described above, and the greater part thereof is normally filled with the liquid. A reference numeral 110 denotes a liquid injection port. A reference numeral 111 denotes a gap between a partitioning portion 112 in the liquid pressurizing chamber and the piezo-electric actuator 103. A reference numeral 114 denotes a substrate for polishing stopper, and is, for example, a substrate made of stainless steel. In this respect, as the aperture according to the present invention, there are two: a window in the upper part of the liquid pressurizing chamber 109 and an injection port 110 in the lower part in case of the present embodiment. In this respect, further as an aperture which is not arranged to oppose to the actuator 103, another aperture may be provided in the liquid pressurizing chamber 109. In this case, the actuator 103 needs to be small to such a degree that it does not hinder the pressurizing operation on deforming under pressure.

Next, the description will be made of the structure and dimensions of a liquid injection device according to the present embodiment. The piezo-electric substrate 101 and the diaphragm 102 are bonded together with adhesive. The piezo-electric substrate 101 has 20 μm in thickness, 2.0 mm in length, and 200 μm in width. The actuator portion of the diaphragm 102 has 70 μm in thickness and the same length and width as the piezo-electric substrate 101. Also, a gap between the liquid injection elements which are adjacent each other is set to about 79 μm in such a manner that 90 elements are arranged per width of one inch. The piezo-electric actuator 103 is at its both ends, fixed to the holding substrate 107 to constitute an unimorph actuator supported at both ends. The liquid passage 108 has 8 mm in length and 200 μm in depth. Also, the liquid pressurizing chamber 109 has inner dimensions of 1.9 mm in length, 140 μm in width and 400 μm in depth. The partitioning portion 112 in the liquid pressurizing chamber has an outside shape as viewed from the upper surface: 2.0 mm in length and 200 μm in width. The substrate 106 for formation of the injection port has a thickness of 30 μm, and the aperture diameter of the injection port 110 is 30 μm. Also, the substrate 105 for formation of the liquid chamber and the substrate 106 for formation of the injection port are bonded together with adhesive. Also, the length g of the gap 111, that is, the distance between the piezo-electric actuator 103 and the partitioning portion 112 in the liquid pressurizing chamber is about 10 μm in a state in which no voltage is applied to the piezo-electric actuator 103. Also, the substrate 114 for polishing stopper has a thickness of 30 μm. However, the dimensions described above indicate as an example, and other dimensions can be used. Also, the same is applicable to other embodiments 2 to 19.

Also, although not clearly shown in the figure for brevity, electrodes on the upper surface of each liquid injection element are brought out to an electrode leading pad which has been provided in advance on the holding substrate 107 by wire bonding.

Next, with reference to FIGS. 3 and 4, the description will be made of a manufacturing method for a liquid injection device according to the present embodiment. First, with reference to FIGS. 3(*a*) to 3(*f*), which are top views for each substrate, the description will be made of the manufacturing method for each component in order. A stainless steel substrate is machined into such a shape as shown in the figure by means of mechanical cutting work to be made into a holding substrate 107 (FIG. 3(*a*)). Next, the outside shape of a piezo-electric ceramic substrate with a thickness of 200 μm is cut by a dicing saw into a piezo-electric substrate 101 (FIG. 3(*b*)). Next, the stainless steel substrate is hollowed out by means of etching to be made into a diaphragm 102 (FIG. 3(*c*)). A stainless steel substrate is hollowed out by means of etching to be made into a substrate 114 made of stainless steel used as a polishing stopper (FIG. 3 (*d*)). The substrate 114 for a polishing stopper is set to the same thickness as that of the piezo-electric substrate 101 to be finally desired. For example, in the present embodiment, since the final thickness of the piezo-electric substrate 101 is 20 μm, the thickness of the substrate 114 for polishing stopper is set to 20 μm in advance. A stainless steel substrate is half-etched to form a liquid passage 108, and further a liquid pressurizing chamber 109 is formed by laser beam machining to be made into a substrate 105 for formation of a liquid chamber (FIG. 3(*e*)). A substrate 106 for formation of an injection port is formed by means of electroforming (FIG. 3(*f*)).

Next, with reference to FIG. 4, the description will be made of a manufacturing method for a piezo-electric actuator 103. FIGS. 4(*a*), (*b*) and (*e*) are top views, and FIGS. 4(*c*) and (*d*) are cross-sectional views for FIGS. 4(*a*) and (*b*) respectively. At the beginning, the piezo-electric substrate 101, the diaphragm 102, and the substrate 114 for a polishing stopper are fixed with adhesive as shown in FIGS. 4(*a*) and (*c*). In FIG. 4(*c*), the interval between the piezo-electric substrate 101 and the substrate 114 for a polishing stopper is about 25 82 m.

Next, the piezo-electric substrate 101 is polished to a thickness of 20 μm (FIGS. 4(*b*) and (*d*)). At this time, since the thickness of the substrate 114 for a polishing stopper has been set to 20 μm in advance, the piezo-electric substrate 101 is hardly polished at a point of time whereat the thickness of piezo-electric substrate 101 becomes 20 μm. This is because the polishing speed for the substrate 114 made of stainless steel for a polishing stopper is sufficiently slower than that for the piezo-electric substrate 101, and the substrate 114 for a polishing stopper plays a part of stopping the polishing of the piezo-electric substrate 101. Next, of the piezo-electric substrate 101, a process of removing portions not overlapping with the diaphragm 102 is performed. Fine abrasive grains are injected onto the substrate from the underside of FIG. 4(*d*) to work only the piezo-electric substrate 101 into the shape of FIG. 4(*e*). This method is generally called "sandblast", and the diaphragm 102 plays a part of a mask on working the piezo-electric substrate 101. Even in this working method, the fact that the diaphragm 102 has lower working speed than the piezo-electric substrate 101 is utilized.

Finally, each substrate is bonded and assembled to thereby complete the liquid injection device according to the present embodiment.

Figure 17:
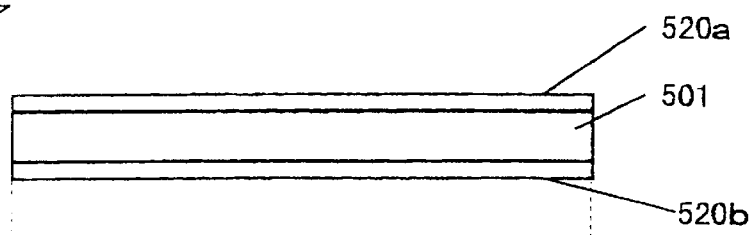
FIGS. 17(*a*)–17(*b*) is a view showing the principle of operation of an unimorph type piezo-electric actuator.
Figure 17:
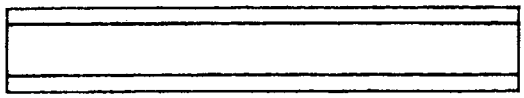
Figure 17:
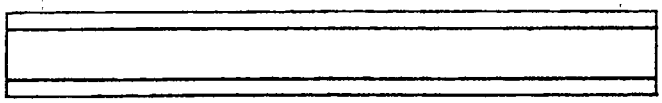
Figure 17:
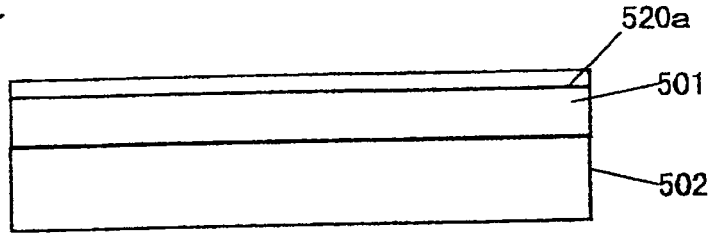
Figure 17:
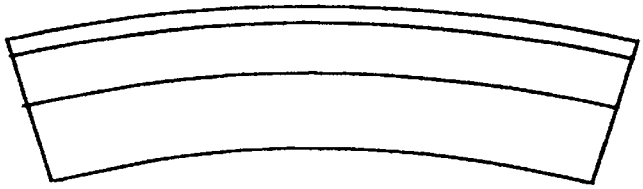
Figure 17:
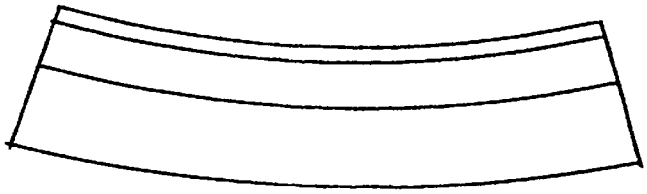
Figure 18:
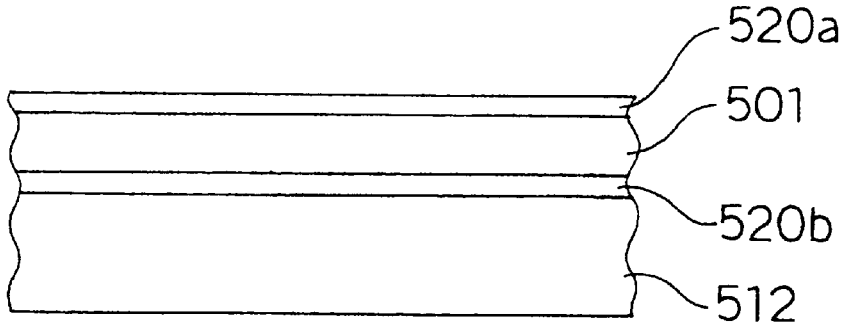
FIGS. 18(*a*)–18(*b*) is a view showing another structure of an unimorph type piezo-electric actuator.
Figure 19A:
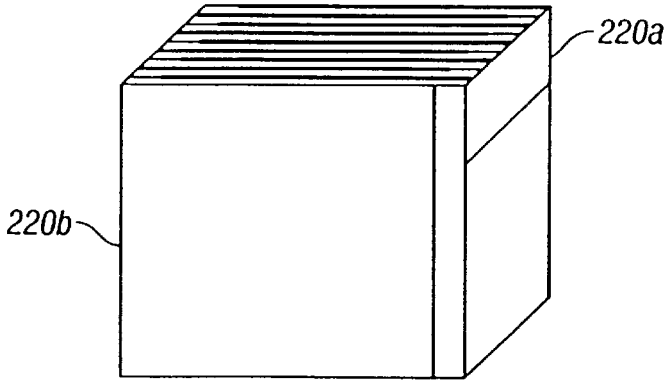
FIGS. 19(*a*)–19(*b*) is a view showing the principle of operation of a laminating type piezo-electric actuator.
Figure 19B:
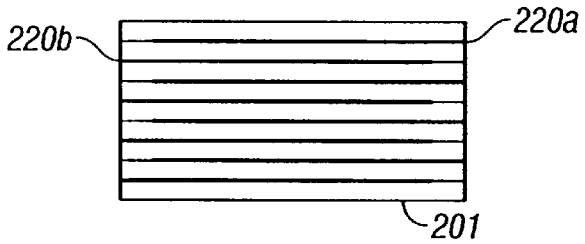
Figure 19C:
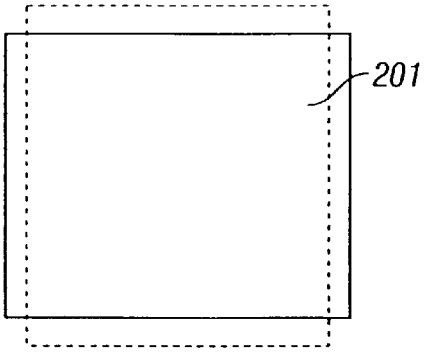
Figure 19D:
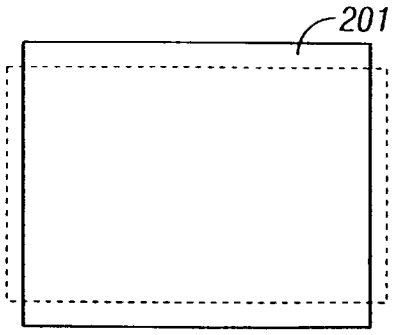

Next, the description will be made of an injection method in a liquid injection device according to the present embodiment. First, the principle of operation of the piezo-electric actuator 103 will be described with reference to FIG. 17. FIGS. 17(*a*) to (*c*) show the operation of the piezo-electric substrate as a single unit, and FIGS. 17(*d*) to (*f*) show the operation of a piezo-electric actuator 503. Basically, the piezo-electric actuator 103 and the piezo-electric actuator 503 have the same principle of operation. In FIG. 17, a reference numeral 501 denotes a piezo-electric substrate; 520*a*, an upper surface electrode provided on the piezo-electric substrate; 520*b*, a lower surface electrode; 502, a diaphragm, for example, conductive material such as metal; and 503, an unimorph type piezo-electric actuator. First, the operation of the piezo-electric substrate 501 will be described. When a pulse electric field is applied onto the piezo-electric substrate 501 in the thickness-wise direction, that is, voltage is applied between the upper surface electrode 520*a* and the lower surface electrode 520*b*, the piezoelectric substrate 501 has characteristic properties that it expands or contracts in the length-wide direction (lateral direction). For example, the piezo-electric substrate 501 has such characteristic properties that when a minus electric field is applied, the piezo-electric substrate 501 contracts as shown in FIG. 17(*b*), and when a plus electric field is applied, it expands as shown in FIG. 17(*c*). By alternately applying plus and minus electric fields onto a piezo-electric substrate having such characteristic properties, it is possible to obtain an expansion or contraction operation of the piezo-electric substrate. Such an operation pattern is called a mode of lengthwise vibration. Next, the description will be made of the piezo-electric actuator 503. When pulse voltage is applied across the upper surface electrode 520*a* and the diaphragm 502 in FIG. 17(*d*), the piezo-electric substrate 501 is going to contract if a minus electric field is applied, but the diaphragm 502 is going to maintain its state, and as a result, the piezo-electric actuator 503 sags down in the convex form downward as shown in FIG. 17(*f*). If a plus electric field is applied conversely, the piezo-electric substrate 501 is going to expand, but the diaphragm 502 is going to maintain its state, and as a result, the piezo-electric actuator 503 bends in the convex form upward as shown in FIG. 17(*e*). By alternately applying plus and minus electric fields in this manner, a bending operation of the piezo-electric actuator 503 can be obtained. Such operation pattern is called a mode of bending vibration. In this respect, in the foregoing description, the diaphragm 502 has been used as conductive material, but a substrate of insulating material or semiconductor or the like may be used as a diaphragm, and in that case, such a structure as shown in, for example, FIG. 18 is used. In FIG. 18, a lower surface electrode 520*b* is provided in the underside of the piezo-electric substrate 501 and is bonded to the diaphragm 512. The operation is the same as in the mode of bending vibration.

Figure 21A:
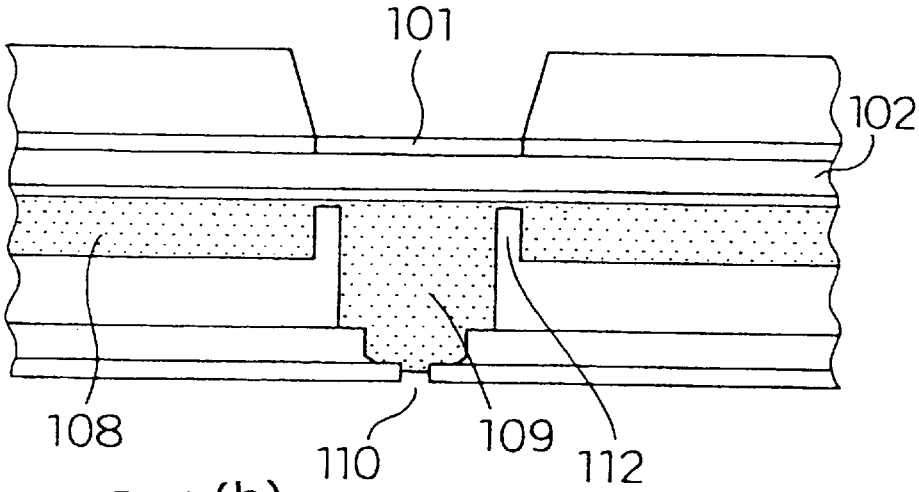
FIGS. 21(*a*)–21(*b*) is a view showing the principle of liquid injection in the first embodiment of the present invention.
Figure 21B:
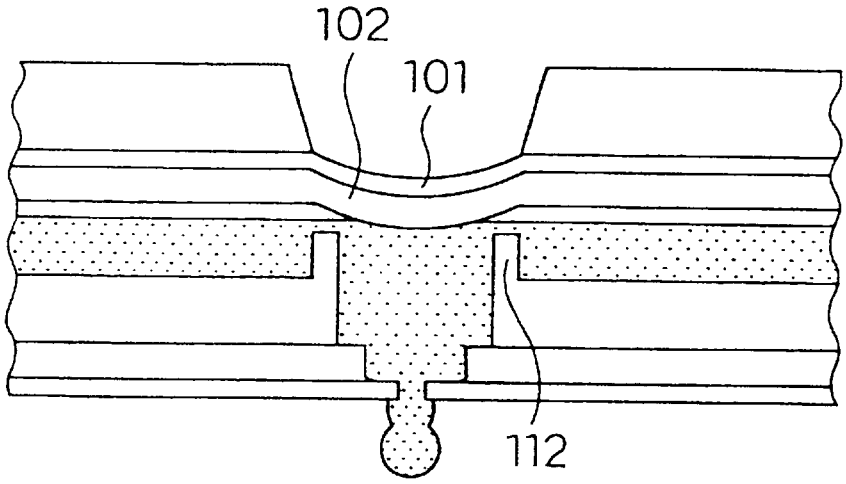
Figure 21C:
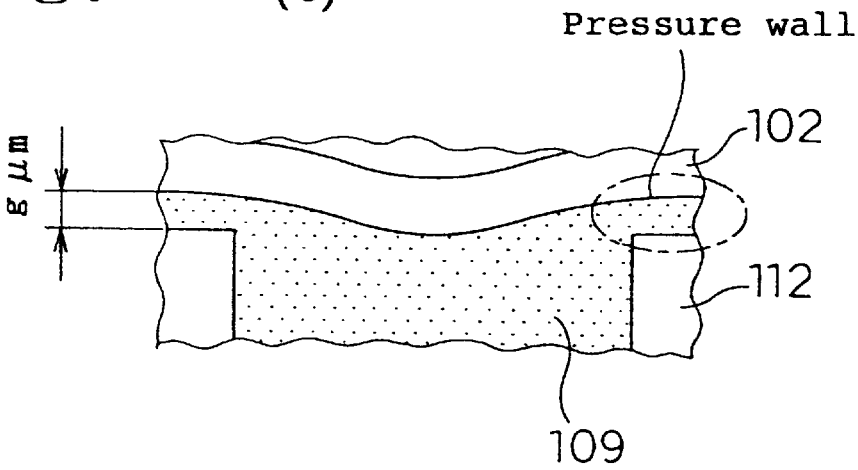

Next, with reference to FIG. 21, the description will be made of the liquid injection method. FIG. 21(*a*) is a cross-sectional view showing the liquid injection element in a state in which no voltage is applied, FIG. 21(*b*) is a cross-sectional view showing the liquid injection element when voltage is applied, the piezo-electric actuator 103 is displaced, and liquid is injected through the liquid injection port 110, and FIG. 21(*c*) is an enlarged view showing the liquid pressurizing chamber 109 portion when the piezo-electric actuator 103 is brought closest to the partitioning portion 112 in the liquid pressurizing chamber. The description will be made below. Liquid supplied to the liquid passage 108 of each element from a liquid tank (not shown in the figures) for the liquid injection device is supplied to the liquid pressurizing chamber 109 through the gap 111 by a capillary phenomenon or a difference in pressure between each chamber (FIG. 21(*a*)). The difference in pressure is generated by operating the piezo-electric actuator 103 or sucking from the liquid injection port 110 among others. When the piezo-electric actuator 103 is bent and displaced on the side (underside) of the partitioning portion 112 in the liquid pressurizing chamber, the length g of the gap 111 becomes smaller than the initial value. Although it differs depending upon the viscosity properties of the liquid and the physical properties of the partitioning material, when the value of g becomes 10 to about 2 $\mu$m, the liquid pressurizing chamber 109 enters an actually intercepted state from the liquid passage 108 by means of the viscosity properties of the liquid filled in the gap 111 (FIG. 21(*c*)). At this time, the gap 111 is in a liquid-filled state, and this thin liquid layer plays a part of a pressure wall for preventing pressure from leaking from the liquid pressurizing chamber 109 to the liquid passage 108. More specifically, since the liquid pressurizing chamber 109 is actually intercepted from the liquid passage 108, the pressure hardly leaks to the liquid passage 108, and only the pressure within the liquid pressurizing chamber 109 increases. The foregoing operation injects the liquid through the liquid injection port 110 (FIG. 21(*b*)). After the injection, the pressure within the liquid pressurizing chamber 109 lowers, the piezo-electric actuator 103 is displaced upward, and the liquid is supplied again from the liquid passage 108. As the major factors for supplying the liquid, one of them is naturally a difference in pressure between the liquid passage 108 and the liquid pressurizing chamber 109, and in addition, there is also an effect due to the capillary phenomenon. Also, the phenomenon described above can be looked at from a different angle. In a state in which the length g is small, the piezo-electric actuator 103 is actually in such a state as to be supported over the entire circumference by the partitioning portion 112 in the liquid pressurizing chamber. In other words, through the use of the structure and the injection method according to the present invention, it is possible to construct the actuator such that the both-end support in which the displacement can be taken large or the entire-circumference support which promotes an increase in pressure can be adopted.

In a liquid injection device according to the present embodiment described above, the number of controllable gradation levels is 6 to 10 value, and has become larger than the conventional piezo-electric type and the comparative example to be described later.

Next, the description will be made of the features and effects of the structure of the liquid injection device and the injection method according to the present embodiment described above. The structural features of the liquid injection device according to the present embodiment are that the piezo-electric actuator 103 and the liquid pressurizing chamber 109 are separated at a predetermined gap therebetween, and that the piezo-electric actuator 103 is fixed by any portions other than partitioning constituting the inner wall of the liquid pressurizing chamber 109. Also, since it is not necessary to cause the interior of the liquid pressurizing chamber 109 to be in an enclosed state in advance by the piezo-electric actuator 103, it is possible to adopt, as the supporting method, the both-end support, in which the displacement amount can be taken large, instead of the entire-circumference support normally used for supporting on all sides. Also, the feature of the injection method in the liquid injection device according to the present embodiment is that when the length g of the gap 111 becomes small, the liquid filled in the gap 111 operates like a pressure wall so that the liquid pressurizing chamber 109 enters an actually intercepted state from the liquid passage 108, and only the liquid pressurizing chamber 109 is placed in a high-pressure state to inject the liquid. Unlike the conventional type liquid injection device described in the prior art, the increase in pressure within the liquid passage 108 is negligible as compared with the increase in pressure in the liquid pressurizing chamber 109, and almost all the work done by the piezo-electric actuator 103 is used to increase the pressure within the liquid pressurizing chamber 109. In other words, the energy utilization efficiency becomes higher than the conventional piezo-electric type.

The effects obtained from the above-described features will be described. The amount of liquid drops to be injected increases as a volumetric amount to be pressed by the piezo-electric actuator, a so-called volumetric decrease amount $\Delta V$ becomes larger. Since the volumetric decrease amount $\Delta V$ is a product of a displacement amount $\xi$ of the piezo-electric actuator and the cross-sectional area S1 of the liquid pressurizing chamber, the displacement amount ξ can be made large (large displacement properties). In other words, if a variable width of the displacement ξ can be made large, the amount of liquid drops can be also widely changed, and as a result, the modulation width can be widely taken. The larger the modulation width is, the more the number of gradation levels can be increased.

Also, when it is placed in a high-pressure state, the liquid pressurizing chamber 109 enters an intercepted state from the liquid passage 108, and therefore, the liquid in the liquid pressurizing chamber 109 hardly flows backwards into the liquid passage 108. In other words, little pressure leaks into the liquid passage 108. Therefore, the energy utilization efficiency is improved, and the modulation width can be taken large. Also, for the same reason, it becomes possible to make, faster, a rate of switching a low-pressure state to a high-pressure state in the liquid pressurizing chamber 109 although the rigidity of the piezo-electric actuator 103 is comparatively low. In other words, it becomes possible to improve the response characteristic of pressure, and to inject small liquid drops, and the modulation width is further enlarged. Further, for the reasons that after the injection, the difference in pressure between the liquid passage 108 and the liquid pressurizing chamber 109 is high, and that the gap 111 is small and the effect by the capillary phenomenon is great, among others, there are effects that the ability of supplying the liquid to the liquid pressurizing chamber 109 after the injection becomes higher, the liquid can be sufficiently supplied even if the piezo-electric actuator 103 is driven at high speed, and high-speed printing can be made, and that even when air bubbles are mixed, deaeration can be performed while liquid is being injected, among others. In this respect, even when the liquid injection device according to the present embodiment is not used as multi-tone printing, there is also an effect that power consumption of the liquid injection device can be made lower because of high energy utilization efficiency.

In this respect, it is not necessary to completely fill the liquid passage 108 with liquid, but the liquid passage 108 can be filled to such a degree that the liquid can. be supplied to the liquid pressurizing chamber 109 by the operation of surface tension and the above-described difference in pressure.

Second Embodiment

Figure 26A:
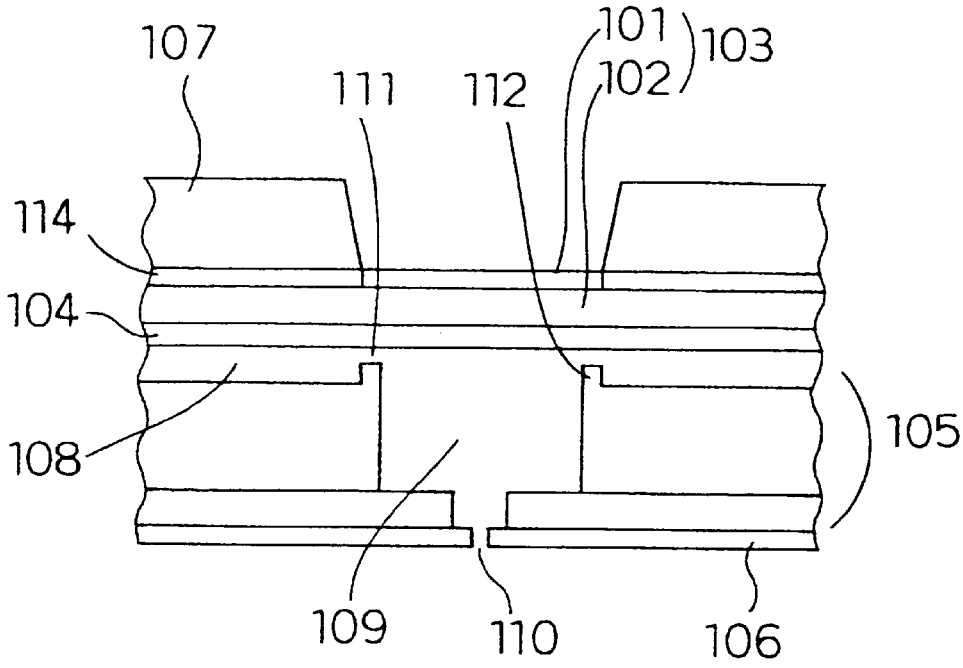
FIGS. 26(*a*)–26(*b*) is a view showing a liquid injection device according to a second embodiment of the present invention.
Figure 26B:
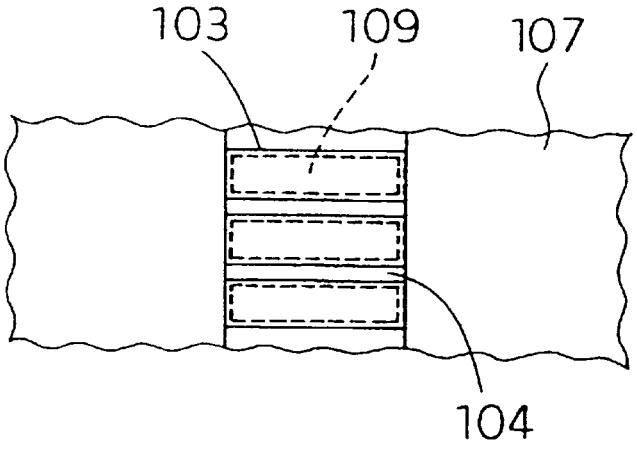

With reference to FIG. 26, the description will be made of a second embodiment of a liquid injection device according to the present invention. Also, since the liquid injection device according to the present invention is partly redundant with the first embodiment, only different points from it will be described.

The structure of the liquid injection device according to the present embodiment is different from the first embodiment in that a resin sheet 104 is inserted between the piezo-electric actuator 103 and the partitioning portion 112 in the liquid pressurizing chamber. The resin sheet 104 has a thickness of about 10 μm.

The injection method according to the present embodiment is generally the same as that of the first embodiment, and therefore only different points will be described. When the piezo-electric actuator 103 is bent and shifts downward, the resin film 104 whose rigidity is sufficiently lower than that of the piezo-electric actuator 103 becomes deformed upward while the volume of the liquid passage 108 is hardly changed. Therefore, the increase in pressure is very small. In this respect, if for the resin sheet 104 to be inserted, there is used a resin sheet whose bending rigidity is sufficiently lower than that of the piezo-electric actuator 103, it will be possible to reduce, to a minimum, the reduced displacement amount in the piezo-electric actuator 103, deteriorated energy utilization efficiency or deteriorated pressure response characteristic due to the insertion of the resin sheet 104.

When the liquid injection device according to the present invention described above is used, it becomes possible to prevent liquid from flowing out through a gap in a liquid injection device adjacent thereto, and this leads to the effect that there are eliminated defects that the liquid flows out to deteriorate the impedance between the upper surface electrode of the piezo-electric actuator 103 and the diaphragm which is the lower surface electrode, and that the liquid flowed out deteriorates the piezoelectric substrate 101.

Third Embodiment

A third embodiment of a liquid injection device according to the present invention will be described. Since the present embodiment is partly redundant with the first embodiment, the different points from it will be particularly described with reference to FIG. 1. The present embodiment is different from the first embodiment in dimensions of the piezo-electric actuator 103 and the liquid pressurizing chamber 109 and arrangement intervals of the liquid injection elements. Further, the description will be made in detail. The piezo-electric actuator 103 has a length of 1.5 mm and a width of 100 μm. Also, the interval of the adjacent elements is about 41 μm, and 180 elements per width of 1 inch are to be arranged. The liquid pressurizing chamber 109 has inside dimensions: 1.4 mm in length, 60 μm in width and 400 μm in depth.

The partitioning portion 112 in the liquid pressurizing chamber has an outside shape as viewed from the upper surface of 1.0 mm in length and 100 μm in width.

The injection method and features of the liquid injection device according to the present embodiment are generally the same as those of the first embodiment.

In the present embodiment, although the number of gradation levels is four value, which is the same as that in the conventional piezo-electric type liquid injection device, the liquid injection elements are arranged at a narrow pitch, and high-resolution printing can be implemented while the lowered printing speed is being restrained. Also, the dot reproducing ability at the time of tonal expression is also high, and its control is also easy. The reason will be further described. The diameter of the liquid drops to be injected becomes a function of the volumetric decrease amount ΔV (the larger ΔV is, the larger the liquid drop diameter becomes) ΔV is, as described above, a product of a displacement ξ of the piezo-electric actuator and the cross-sectional area S1 of the liquid pressurizing chamber. In the present embodiment, since the same modulation width as in the conventional liquid injection device is taken, the small cross-sectional area S1 is made up for by enlarging the variable width for the displacement ξ. Namely, an increment in the displacement ξ on raising the gradation level by one also becomes larger. As a result, it is not necessary to finely control the displacement ξ in comparison with the conventional liquid injection device, and since the dot diameter will be less affected by the fluctuation of the displacement ξ from a desired value, it becomes possible to implement a liquid injection device with high level of controllability.

In this respect, high dot reproducing ability and easy control are not limited to the present embodiment, but when compared with the conventional piezo-electric type ink injection device described in the prior art, the same is applicable to other embodiments. It is essential that the variable width of the displacement ξ is large.

Fourth Embodiment

Figure 5A:
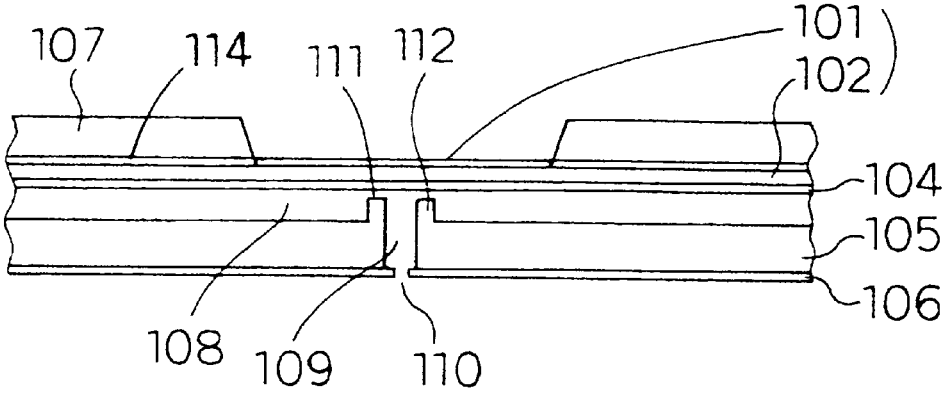
FIGS. 5(*a*)–5(*b*) is a view showing a liquid injection device according to a fourth embodiment of the present invention.
Figure 5B:
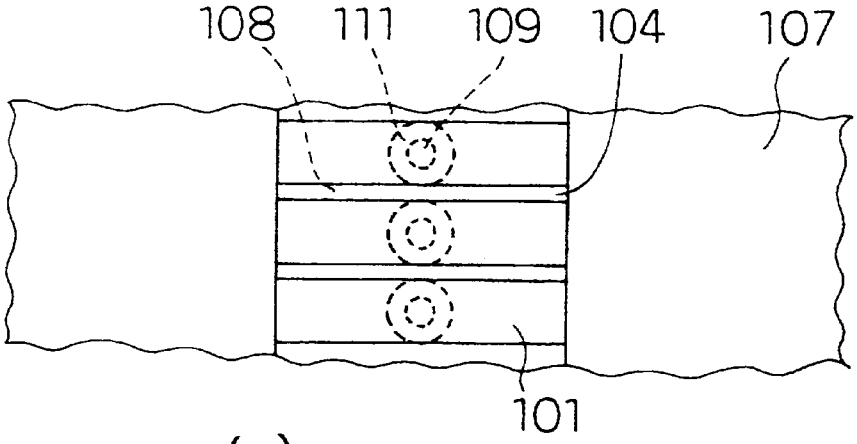
Figure 5C:
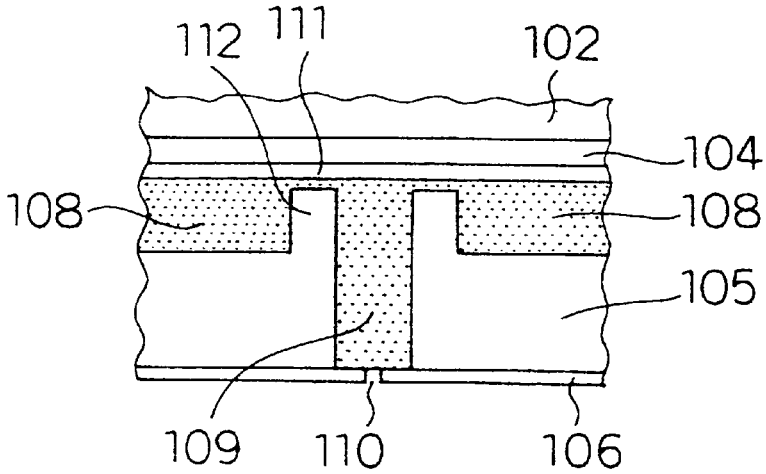
Figure 6:
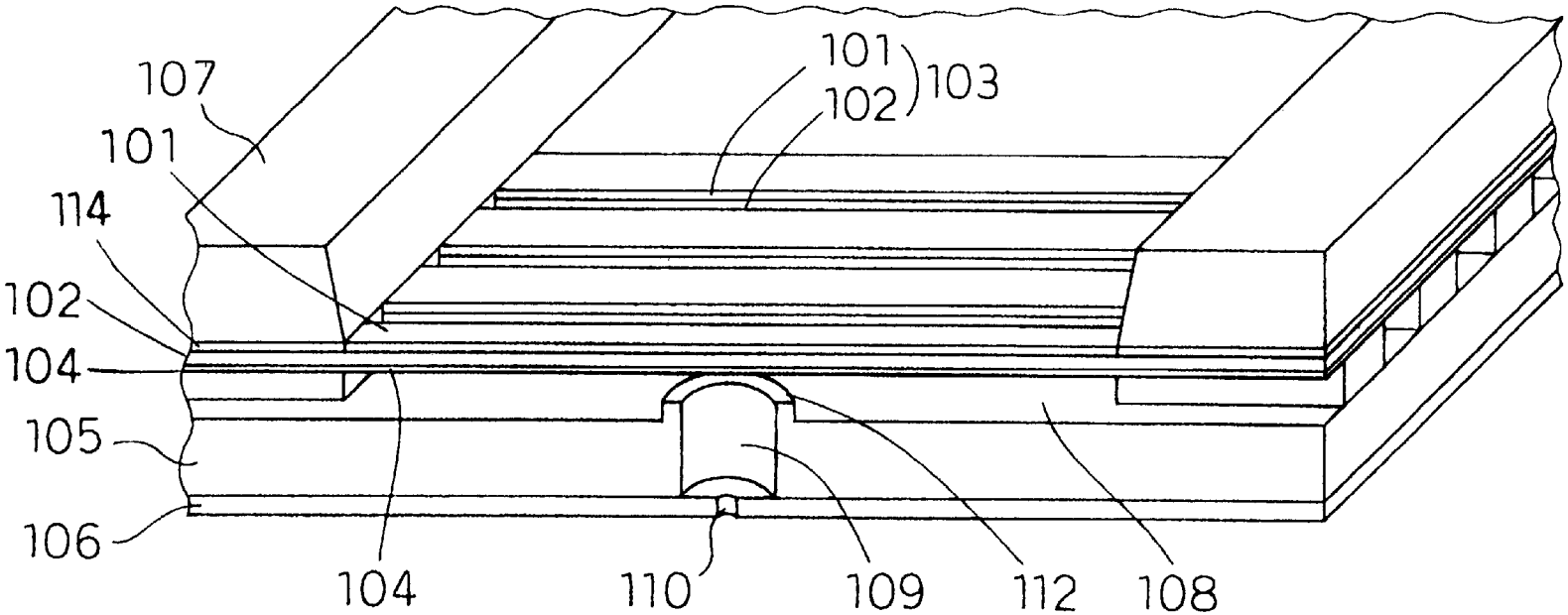
FIG. 6 is a view showing a liquid injection device according to the fourth embodiment of the present invention.

With reference to FIG. 5, the description will be made of a fourth embodiment of a liquid injection device according to the present invention. FIG. 5(*a*) is a cross-sectional view, and FIG. 5(*b*) is a top view. FIG. 5(*c*) is an enlarged view showing the vicinity of the liquid pressurizing chamber 109, and FIG. 6 is a perspective view showing a liquid injection device. In FIG. 5, reference numerals 101 to 112 and 114 have generally the same meaning as the first embodiment with the exception of those clearly specified in the description of the present embodiment.

The description will be made of the structure and dimensions of the liquid injection device according to the present embodiment. A piezo-electric substrate 101 has 20 μm in thickness, 2 mm in length and 200 μm in width, and an actuator portion of a diaphragm 102 has 40 μm in thickness, 2 mm in length and 200 μm in width, and they are bonded together with adhesive to form a piezo-electric actuator 103. A gap between the elements which are adjacent each other is about 79 μm, and 90 elements are arranged per width of 1 inch. A resin sheet 104 has a thickness of about 5 μm, and is bonded together to a diaphragm 102 and a substrate 105 for formation of a liquid chamber by means of adhesive and contact bonding. A liquid passage 108 has a length of 2 mm and a depth of 200 μm. Also, a liquid pressurizing chamber 109 has an inner diameter of 140 μm and a depth of 400 μm, and a partitioning portion 112 in the liquid pressurizing chamber is shaped like a doughnut having an outside diameter of 200 μm and an inside diameter of 140 μm as viewed from the upper surface. A substrate 106 for formation of an injection port has a thickness of 40 μm, and the aperture diameter of the injection port 110 is 40 μm. Also, the substrate 105 for formation of a liquid chamber and the substrate 106 for formation of an injection port are bonded together with adhesive. Also, the length g of a gap 111, that is, a distance between the resin sheet 104 and the partitioning portion 112 in the liquid pressurizing chamber is about 10 μm in a state in which no voltage is applied to the piezo-electric actuator 103. Also, a substrate 114 for polishing stopper has the same thickness, 20 μm, as the piezo-electric substrate 101.

The manufacturing method for the liquid injection device according to the present embodiment is generally the same as the first embodiment.

The injection method in the liquid injection device according to the present embodiment is generally the same as a combination of the first and second embodiments. The operation principle of the piezo-electric actuator 103 and the method for supplying the liquid to the liquid passage 108 and the liquid pressurizing chamber 109 are the same as in the first embodiment.

When a liquid injection device according to the present embodiment described above is used, the modulation width exceeds 100, and the number of controllable gradation levels exceeds 32 value, and these dramatically become large as compared with the conventional piezo-electric type, the comparative example, and the first embodiment.

The feature of the liquid injection device according to the present embodiment is, in addition to the features described in the first and second embodiments, that the area of the piezo-electric actuator 103 having its displacement direction as the direction of the normal thereto is larger than the cross-sectional area of the liquid pressurizing chamber 109 having the displacement direction of the piezo-electric actuator 103 as the direction of the normal thereto. In the first embodiment, since the area of the piezo-electric actuator 103 is almost the same as the cross-sectional area of the liquid pressurizing chamber 109, the displacement in the piezo-electric actuator 103 is also smaller than the liquid injection device according to the present embodiment. In contrast, in the liquid injection device according to the present embodiment, since the cross-sectional area of the liquid pressurizing chamber 109 is small although the increase in pressure therein is high, the reaction, which is a value obtained by surface-integrating the pressure with respect to the cross-sectional area, becomes lower than in the first or second embodiment. Also, for the same reason as in the first and second embodiments, since the increase in pressure within the liquid passage 108 is low, the reaction which undergoes from the liquid for inhibiting the displacement of the piezo-electric actuator 103 within the liquid passage 108 becomes low.

The following effects are provided by the features described above. By an actuator having a large area, high pressure is generated only within a pressurizing chamber having a smaller cross-sectional area than the actuator, whereby energy generated by the actuator is concentrated on the pressurizing chamber to thereby enable the energy efficiency to be further improved as compared with the first embodiment, and the displacement properties and the pressure response characteristic are also improved, thus dramatically improving the modulation width and the number of gradation levels. Also, for the reasons described in the first embodiment, the effects of high-speed printing, low power consumption and easy deaeration also become more significant than in the liquid injection device according to the first embodiment. In this respect, in the present embodiment, it is not necessary that the liquid passage 108 is completely filled with liquid, but it may be filled to such a degree that the liquid can be supplied to the liquid pressurizing chamber 9. It provides increased energy utilization efficiency that the liquid is not completely filled, but there is an area where the liquid is not filled as shown in FIG. 5(*c*). In such an area where no liquid is filled, for example, gas having a low coefficient of elasticity and high compression properties is preferably mixed. Also, if a part of the substrate 105 for formation of a liquid chamber, which is also the wall of the liquid passage 108, is made of material having low rigidity which is easily deformable or is constructed so as to be easily deformable, the effect of improved energy efficiency can be likewise obtained. The above-described effect results from the fact that the reaction which the piezo-electric actuator 103 undergoes from the liquid within the liquid passage 108 is greatly reduced.

In this respect, according to the present embodiment, assuming that the pose of the liquid injection device is arbitrarily used, the structure is arranged such that the resin sheet 104 is interposed between the piezo-electric actuator 103 and the partitioning portion 112 in the liquid pressurizing chamber to thereby prevent the liquid from flowing out. If, however, the liquid injection device is fixed for use with the actuator facing up, the resin sheet 104 is not always necessary, but by removing it conversely, the reaction which the piezo-electric actuator 103 undergoes from the liquid within the liquid passage 108 is greatly reduced to further improve the energy utilization efficiency, displacement properties and pressure response characteristic.

Fifth Embodiment

Figure 7A:
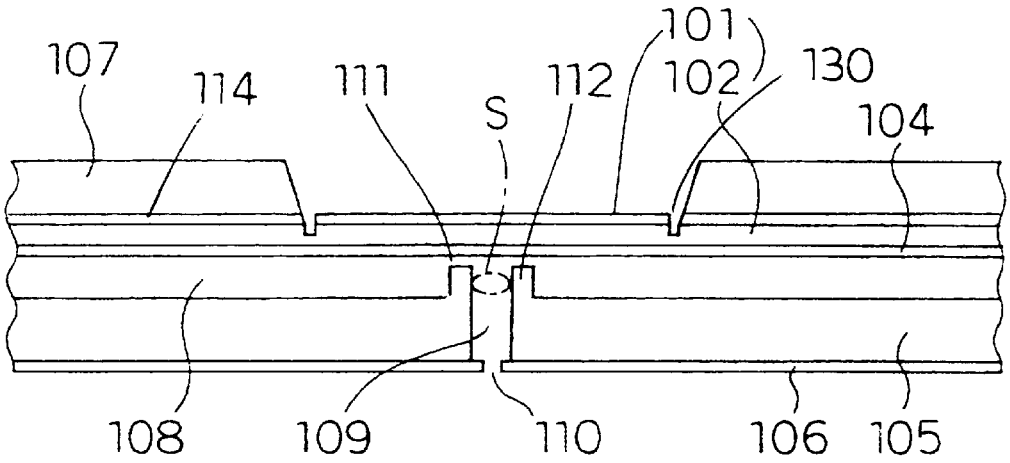
FIGS. 7(*a*)–7(*b*) is a view showing a liquid injection device according to a fifth embodiment of the present invention.
Figure 7B:
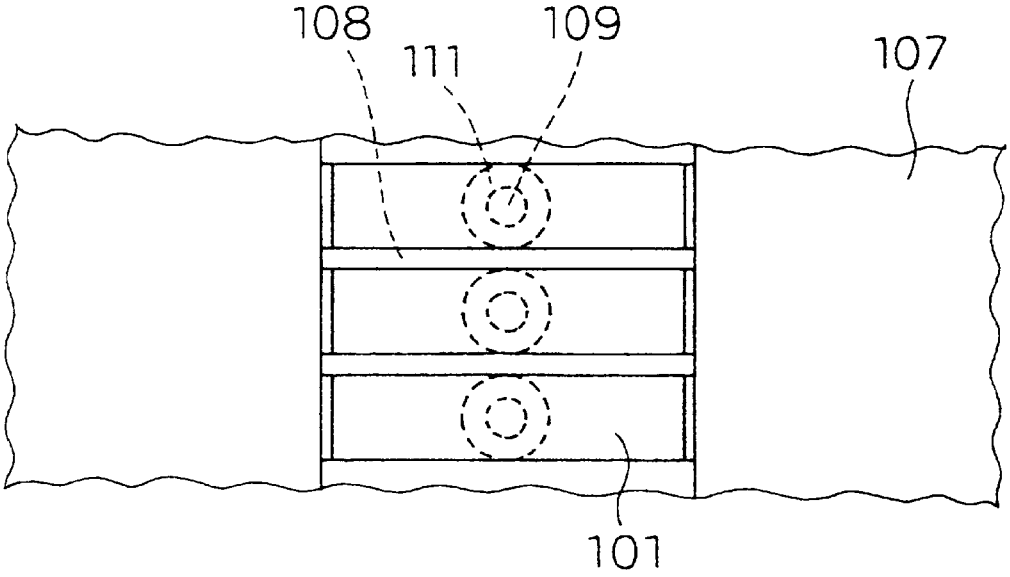

With reference to FIG. 7, the description will be made of a fifth embodiment of a liquid injection device according to the present invention. FIG. 7(*a*) is a cross-sectional view, and FIG. 7(*b*) is a top view. In FIG. 5, reference numerals 101 to 112 and 114 have generally the same meaning as the first embodiment with the exception of those clearly specified in the description of the present embodiment. The structure and dimensions of the liquid injection device according to the present embodiment are partially redundant with those in the fourth embodiment, and therefore, particularly only the different points will be described. In the liquid injection device according to the present embodiment, there is provided a groove 130 having a length of about 50 μm in the longitudinal direction of the piezo-electric actuator 103 and a depth of about 30 μm in the diaphragm 102 in the vicinity of the supporting end of the piezo-electric actuator 103 (FIG. 7).

The liquid injection method in the liquid injection device according to the present embodiment is generally the same as in the fourth embodiment. Also, even in the manufacturing method, if the diaphragm 102 is provided with a predetermined groove in advance, it is generally the same as in the first or fourth embodiment.

The description will be made of the features and effects of the liquid injection device according to the present embodiment.

The feature of the present embodiment is that the piezo-electric actuator 103 in the vicinity of the supporting end has lower rigidity than the other portions thereof. This causes the piezo-electric actuator 103 to artificially rotationally support, further increasing the displacement amount. In the present embodiment, the displacement amount increased by about 1.5 to 2 times as much as that in the fourth embodiment at the same applied voltage. As described above, the large displacement properties are improved and it becomes easier to inject large liquid drops. The injection of large liquid drops increases the amount of injection per unit time, and the printing speed is actually increased. Therefore, high-speed printing can be implemented without impairing the ability of multi-tone printing.

Sixth Embodiment

Figure 9A:
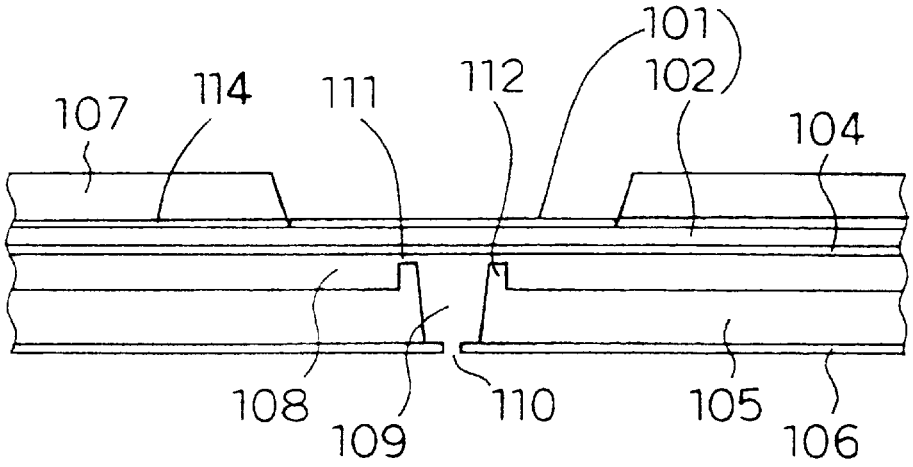
FIGS. 9(*a*)–9(*b*) is a view showing a liquid injection device according to a sixth embodiment of the present invention.
Figure 9B:
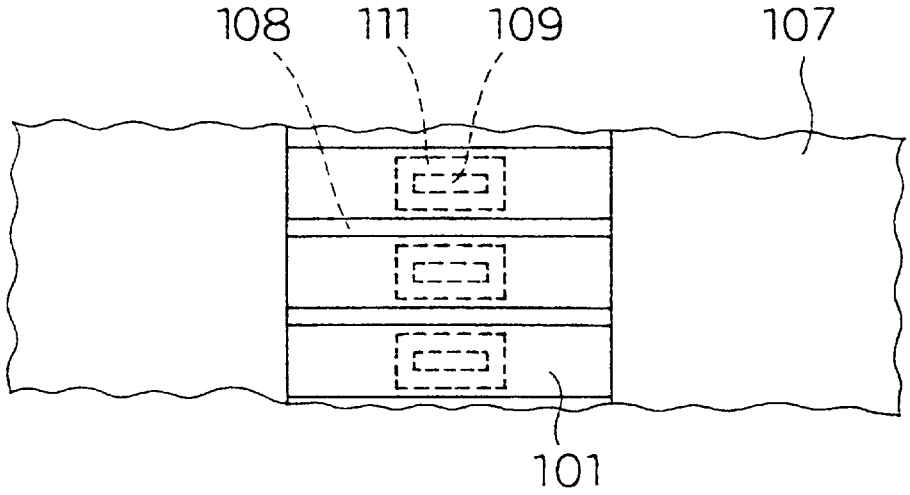

With reference to FIG. 9, the description will be made of a sixth embodiment of a liquid injection device according to the present invention. FIG. 9(*a*) is a cross-sectional view, and FIG. 9(*b*) is a top view. In FIG. 9, reference numerals 101 to 112 and 114 have generally the same meaning as the first embodiment with the exception of those clearly specified in the description of the present embodiment.

The description will be made of the structure and dimensions of the liquid injection device according to the present embodiment. A piezo-electric substrate 101 has 10 μm in thickness, 2 mm in length and 100 μm in width, and an actuator portion of a diaphragm 102 has 20 μm in thickness, 2 mm in length and 100 μm in width, and they are bonded together with adhesive to form a piezo-electric actuator 103. A gap between the elements which are adjacent each other is about 40 μm, and 180 elements are arranged per width of 1 inch. A resin sheet 104 has a thickness of about 5 μm, and is bonded together to the diaphragm 102 and a substrate 105 for formation of a liquid chamber by means of adhesive and contact bonding. A liquid passage 108 has a length of 2 mm and a depth of 200 μm. Also, a liquid pressurizing chamber 109 has a length of 300 μm, a width of 50 μm and a depth of 400 μm, and a partitioning portion 112 in the liquid pressurizing chamber is shaped like a rectangle having an outer shape with a length of 360 μm and a width of 90 μm as viewed from the upper surface. As regards the inner shape, it is naturally the same as the dimensions of the liquid pressurizing chamber 109. A substrate 106 for formation of an injection port has a thickness of 40 μm, and the aperture diameter of the injection port 110 is 40 μm. Also, the length g of a gap 111, that is, a distance between the resin sheet 104 and the partitioning portion 112 in the liquid pressurizing chamber is about 10 μm in a state in which no voltage is applied to the piezo-electric actuator 103. Also, a substrate 114 for polishing stopper has the same thickness, 10 μm, as the piezo-electric substrate 101.

The manufacturing method and the injection method in the liquid injection device according to the present embodiment are generally the same as in the fourth embodiment.

The features and effects of the liquid injection device according to the present embodiment are, in addition to the description in the fourth embodiment, as follows. The cross-sectional shape (FIG. 9(*b*)) of the liquid pressurizing chamber 109 is a rectangle having short sides in the width-wise direction, and the width which the liquid pressurizing chamber 109 has is 90 μm, which is one-half or less of that in the fourth embodiment. Therefore, when the width of the piezo-electric actuator 103 is reduced, it becomes possible to arrange the liquid injection elements at a narrow pitch, and high-speed printing and high resolution printing can be implemented.

In this respect, in the present embodiment, a rate S2/S1 of the area S2 of the piezo-electric actuator 103 to the cross-sectional area S1 of the liquid pressurizing chamber 109 having the displacement direction of the piezo-electric actuator 103 as the direction of the normal thereto becomes smaller than in the fourth embodiment. Therefore, the ability required for multi-tone printing such as the energy utilization efficiency becomes lower than the fourth embodiment. The dimensional design of the liquid injection device can be determined on the basis of the ability required, that is, on which special emphasis is placed, multi-tone printing ability, high-speed printing ability or high resolution printing ability.

Seventh Embodiment

Figure 8A:
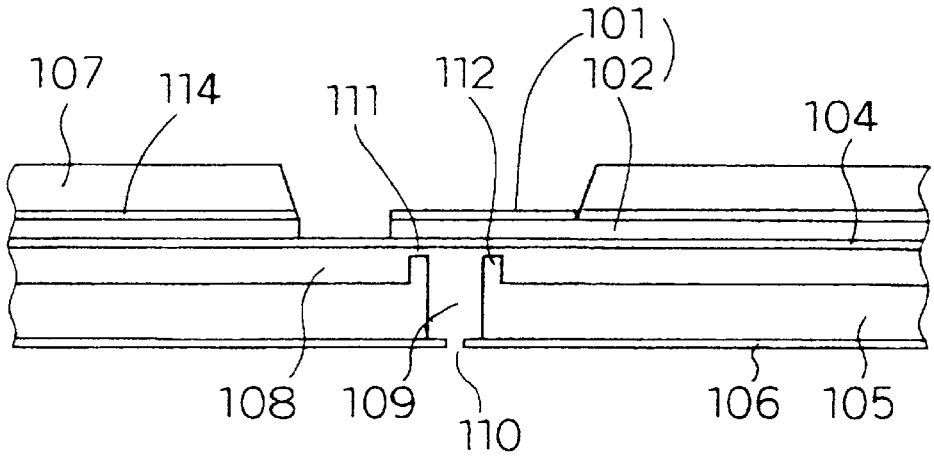
FIGS. 8(*a*)–8(*b*) is a view showing a liquid injection device according to a seventh embodiment of the present invention.
Figure 8B:
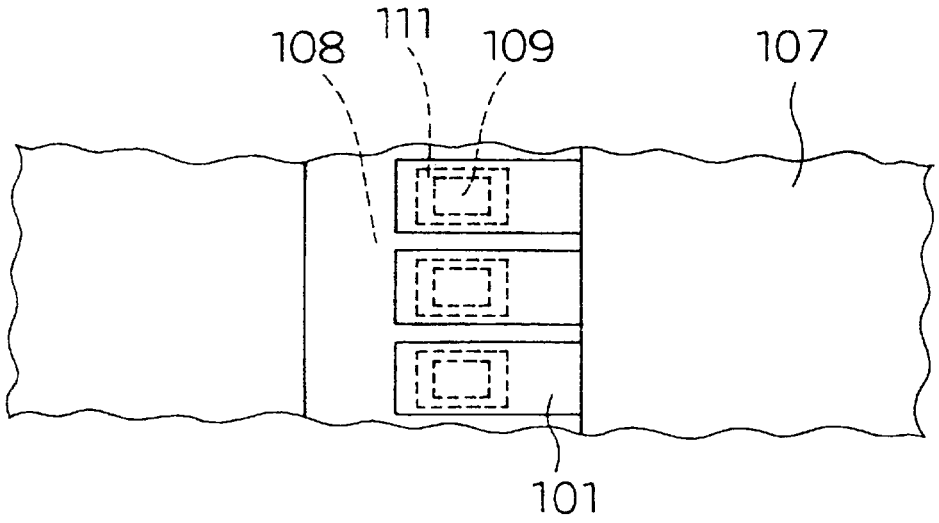

With reference to FIG. 8, the description will be made of a seventh embodiment of a liquid injection device according to the present invention. FIG. 8(*a*) is across-sectional view, and FIG. 8(*b*) is a top view. In FIG. 8, reference numerals 101 to 112 and 114 have generally the same meaning as the first embodiment with the exception of those clearly specified in the description of the present embodiment.

The description will be made of the structure and dimensions of the liquid injection device according to the present embodiment. A piezo-electric substrate 101 has 20 μm in thickness, 1.5 mm in length and 200 μm in width, and an actuator portion of a diaphragm 102 has 40 μm in thickness, 1.5 mm in length and 200 μm in width, and they are bonded together with adhesive to form a piezo-electric actuator 103. A gap between the elements which are adjacent each other is about 79 μm, and 90 elements are arranged per width of 1 inch. A resin sheet 104 has a thickness of about 5 μm. A liquid passage 108 has a length of 2 mm and a depth of 200 μm. Also, a liquid pressurizing chamber 109 has a length of 200 μm, a width of 120 μm and a depth of 400 μm, and a partitioning portion 112 in the liquid pressurizing chamber is shaped like a rectangle having an outer shape with a length of 260 μm and a width of 190 μm as viewed from the upper surface. The other portions are generally the same as in the fourth embodiment.

The manufacturing method and the injection method in the liquid injection device according to the present embodiment are generally the same as in the fourth embodiment.

The features of the liquid injection device according to the present embodiment are that the supporting method for the piezo-electric actuator 103 is cantilever support in which the displacement can be taken large, and that the cross-sectional area of the liquid pressurizing chamber 109 is larger than in the fourth embodiment. From these features, the effects of the improved large displacement properties and the improved volumetric decrease amount ΔV can be obtained, and injection of large-diameter liquid drops can be further easily implemented. Therefore, high-speed printing can be implemented.

Eighth Embodiment

The description will be made of an eighth embodiment of a liquid injection device according to the present invention. The present embodiment is partly redundant with the fourth embodiment, but is different from it in that a reference numeral 101 in FIGS. 5 and 6 denotes a single-crystal piezo-electric substrate, and is, for example, a single-crystal lithium niobate substrate.

The description will be made of the features and effects of the liquid injection device according to the present embodiment.

Figure 23:
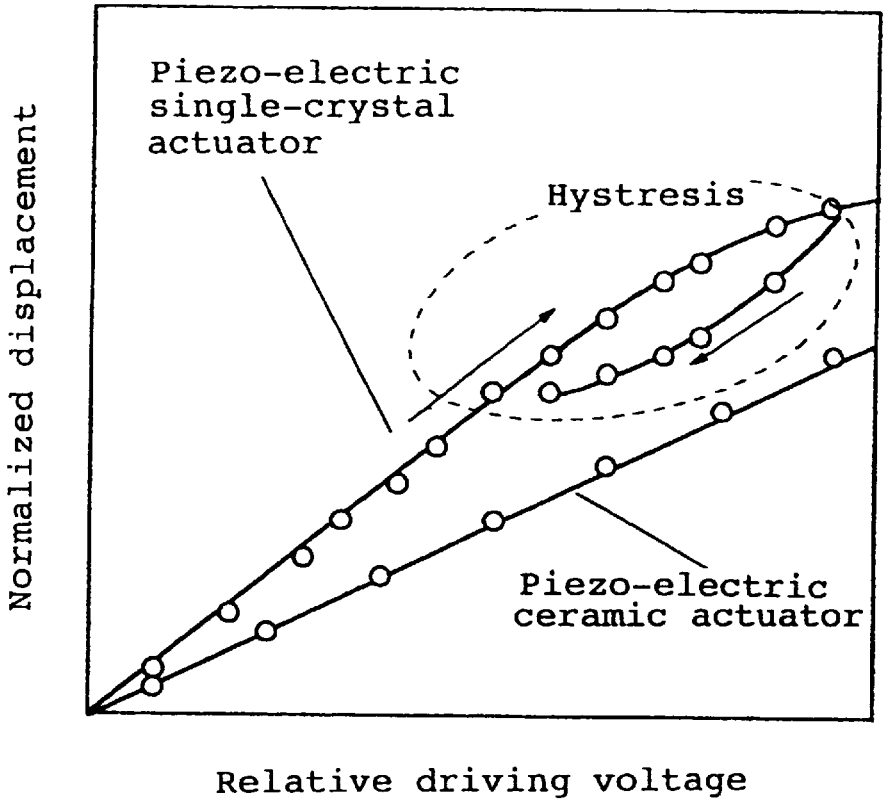
FIG. 23 is a view showing relation between relative driving voltage value and normalized displacement.
Figure 24:
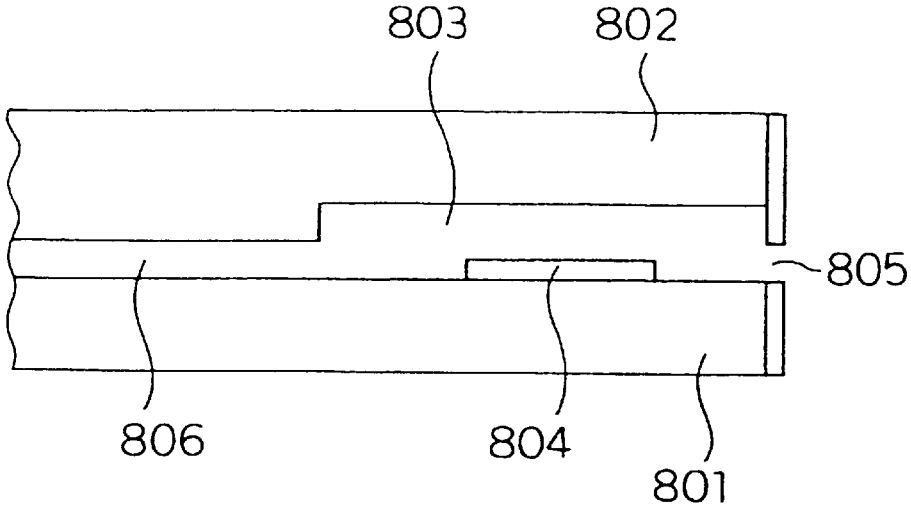
FIG. 24 is a view showing the structure and principle of injection of a heat type liquid injection device.
Figure 25:
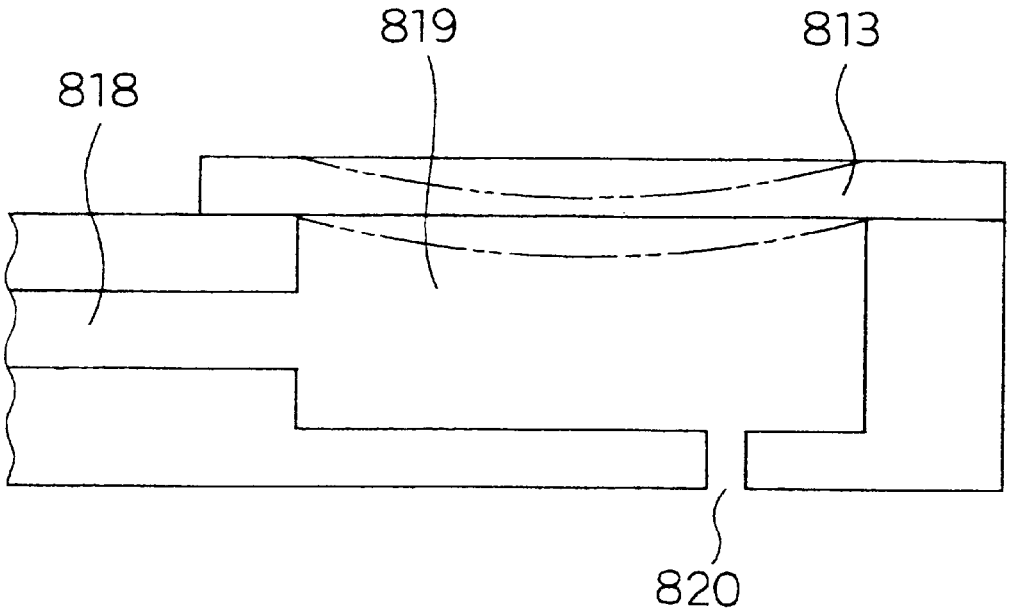
FIG. 25 is a view showing the structure and principle of injection of a piezo-electric type liquid injection device.

The feature of the liquid injection device according to the present embodiment is that as a piezo-electric element constituting the piezo-electric actuator 103, there is used piezo-electric single-crystal material. FIG. 23 shows, including voltage applied history, relation between relative driving voltage value and normalized displacement, concerning a piezo-electric actuator configured by a piezo-electric single-crystal substrate according to the present embodiment and a piezo-electric actuator configured by piezo-electric ceramic material. As shown in the figure, in the piezo-electric ceramic actuator configured by piezo-electric ceramic material, there occurs a phenomenon (hysteresis due to material characteristics), in which the displacement amount of an element differs, even at the same driving voltage value by applied history of the driving voltage value. However, an arrow in the figure indicates the direction of the applied history of voltage. The foregoing hysteresis is a phenomenon which occurs when a polarization state of the piezo-electric ceramic material changes depending upon the applied voltage and the piezo-electric characteristic changes. When a piezo-electric driving element is configured by piezo-electric material having hysteresis based on such material characteristics, it becomes difficult to finely control the displacement amount of the element by the driving voltage value, accordingly to finely control an injected amount of the liquid. Also, the higher the applied voltage value is, the hysteresis based on such material characteristics is prone to occur, which is the cause why the applied voltage value to a piezo-electric actuator using piezo-electric ceramic material cannot be set high. Further, a piezo-electric single crystal has generally higher elastic constant than piezo-electric ceramic material, in other words, it has the effects that if of the same shape, its rigidity becomes high, and has good trackability for high-frequency, and it is resistant to reaction of the liquid among others.

As described above, if the present embodiment is used, it becomes possible to control the gradation in small units even at a small gradation width, and multi-tone printing can be implemented. Further, high-speed printing can be also implemented.

Ninth Embodiment

The description will be made of a ninth embodiment of a liquid injection device according to the present invention. The present embodiment is partly redundant with the fourth embodiment, but is different from it in that a reference numeral 101 denotes a single-crystal piezo-electric substrate, and is, for example, a single-crystal lithium niobate substrate; 102, a diaphragm made of single-crystal silicon, and that the single-crystal piezo-electric substrate 101 and the single-crystal silicon diaphragm 102 are fixed by direct joining.

The direct joining will be further described. The direct joining is implemented in accordance with, for example, the following processes.

(Step a) The surface of the substrate to be superimposed is mirror finished.

Figure 22A:
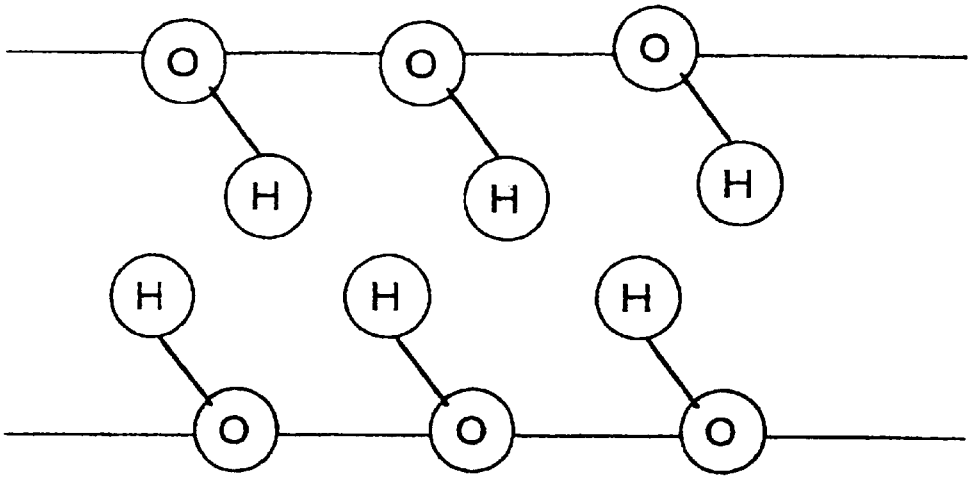
FIGS. 22(*a*)–22(*b*) is a view showing the principle of direct joining.
Figure 22B:
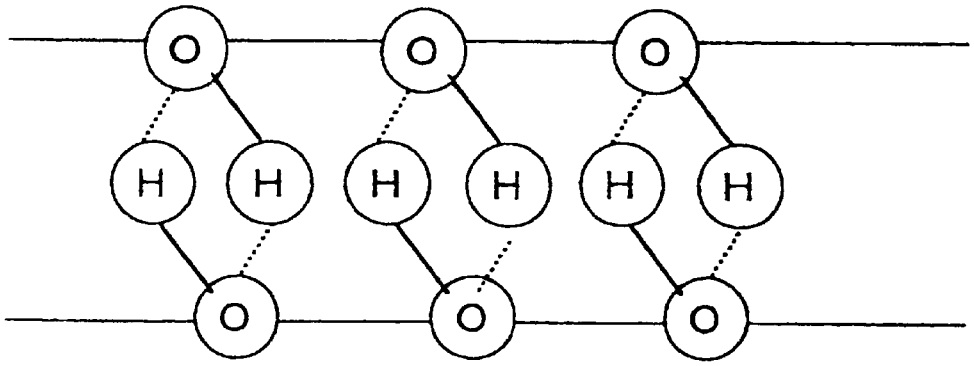
Figure 22C:
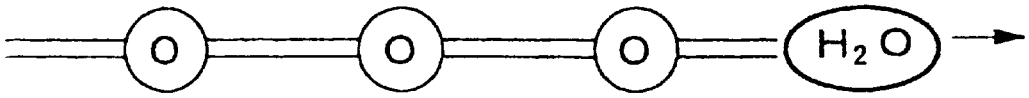

(Step b) The substrate is washed, and the substrate surface is subjected to a hydrophilic process. Then, hydroxyl group is adhered onto the substrate surface (FIG. 22(*a*)).

(Step c) The substrates are superimposed. Then, the hydroxyl group on one surface is hydrogen bonded to the hydroxyl group on the other surface (FIG. 22(*b*)).

(Step d) Heat treatment is performed. Then, water molecules are discharged, and interatomic bond is achieved (FIG. 22(*c*)).

The substrates are directly joined by the above-described processes. Also, the direct joining has generally the following three type joining forms.

(a) Fixed State based on Hydrogen Bonding

A joined state fixed by hydrogen bonding of hydroxyl group intentionally caused to adhere to the substrate surface in a process before the joining, or a trace quantity of water molecules remained or the like.

(b) Fixed State based on Interatomic Bonding

The fixing based on interatomic bonding means a state in which atoms configuring the substrate surface themselves are directly joined without through an intermediate bonding layer comprising any other than atoms configuring the substrate surface such as adhesive. For example, siloxane bonding (Si-O-Si) in joining between silicon substrates corresponds to the interatomic bonding, and covalent bonding or ionic bonding is the interatomic bonding.

(c) Fixed State in which Hydrogen Bonding and Interatomic Bonding coexist

The above-described joined state varies mainly depending upon the heat treatment temperature, and by providing heat treatment at high temperatures, the joined form changes in the order of (a) to (c) to (b), and the joining strength also becomes greater in order.

Since fixing is performed on atomic level in such direct joining, stable joining with almost no deterioration with age can be implemented.

The liquid injection device according to the present embodiment is different from the fourth and tenth embodiments in that firstly the piezo-electric single-crystal substrate 101 and the silicon single-crystal diaphragm 102 are fixed by direct joining, and that secondly as a diaphragm, a silicon substrate with high elastic constant, that is, a silicon substrate with high rigidity is used if of the same shape. First, before the feature and effect of the present invention based on the first different point are described, the description will be made of a problem when such a piezo-electric substrate 101 and a diaphragm 102 as described in the fourth embodiment are bonded with each other with adhesive to configure a piezo-electric actuator 103.

In such a case, under the influence of adhesive, hysteresis occurs in the displacement-driving voltage characteristic. This hysteresis is different in its mechanism of occurrence from the hysteresis based on the material described in the eighth embodiment. The major cause is as follows. When voltage is applied on a ceramic material bimorph element, the element becomes deformed in the direction of flexing (the displacement becomes larger), and at the same time, the adhesive also becomes deformed. Since, however, the adhesive has much lower rigidity than the piezo-electric substrate 101 and the diaphragm 102, even if the piezo-electric substrate 101 and the diaphragm 102 are going to bend and become deformed on the opposite side, the adhesive cannot follow them immediately, but as a result, hinders the piezo-electric actuator 103 from bending and becoming deformed. This noticeably occurs when the displacement amount is large, that is, the applied driving voltage value is high, or when the displacement repeating period is short, that is, the piezo-electric actuator 103 is driven at high speed. When hysteresis based on the adhesive described above occurs, the same problem as described in the eighth embodiment will appear.

The piezoelectric single-crystal substrate 101 and the silicon single-crystal diaphragm 102 are fixed with each other by direct joining on atomic level, which is the first different point according to the present embodiment, whereby all the problems on the hysteresis based on the adhesive are solved, and it becomes possible to control the gradation in small units even at a smaller gradation width than in the eighth embodiment, and multi-tone printing can be implemented. Also, as the diaphragm, which is the second different point, a silicon substrate having higher rigidity is used, whereby higher speed printing can be also implemented than in the eighth embodiment.

Tenth Embodiment

The description will be made of a tenth embodiment of a liquid injection device according to the present invention with reference to FIGS. 5 and 9. The structure and dimensions of the liquid injection device according to the present embodiment are generally the same as in the fourth embodiment with the exception of the liquid pressurizing chamber 109. According to the present embodiment, the liquid pressurizing chamber 109 is shaped like such a rectangle as shown in FIG. 9, and the outer shape of the liquid pressurizing chamber 109 including the partitioning portion 112 in the liquid pressurizing chamber has 400 $\mu$m in length and 200 $\mu$m in width.

Through the use of a liquid injection device according to the present embodiment, the number of controllable gradation levels becomes 16 value. Also, when the outer shape of the liquid pressurizing chamber 109 including the partitioning portion 112 in the liquid pressurizing chamber is set to 600 $\mu$m, 800 $\mu$m and 1 mm, the number of controllable gradation levels becomes about 12 value, 10 to 12 value and 8 to 10 value, and in order to obtain a number of gradation levels of 16 value or more, it becomes necessary to have the structure of the liquid injection device according to the present embodiment. In order to increase the number of gradation levels, it is necessary to increase the modulation widths which are widths of the minimum dot diameter and the maximum dot diameter. In order to increase the modulation width, it is necessary to improve the energy utilization efficiency of the device. As described in the fourth embodiment, the area S2 of the piezo-electric actuator 103 is made larger than the cross-sectional area S1 of the liquid pressurizing chamber 109 having the displacement direction of the piezoelectric actuator 103 as the direction of the normal thereto, whereby it can be achieved to improve the energy utilization efficiency. In order to implement the number of gradation levels of 16 value, which is a sufficient number of gradation levels, for high image quality color printing, however, the area ratio can be set to S2/S1>5 or more as in case of the present embodiment.

The feature of the liquid injection device according to the present embodiment is to set the area ratio so as to satisfy a relation of S2/S1>5, whereby it becomes possible to obtain a number of gradation levels of 16 value or more, and multi-tone printing can be implemented.

Eleventh Embodiment

Figure 10A:
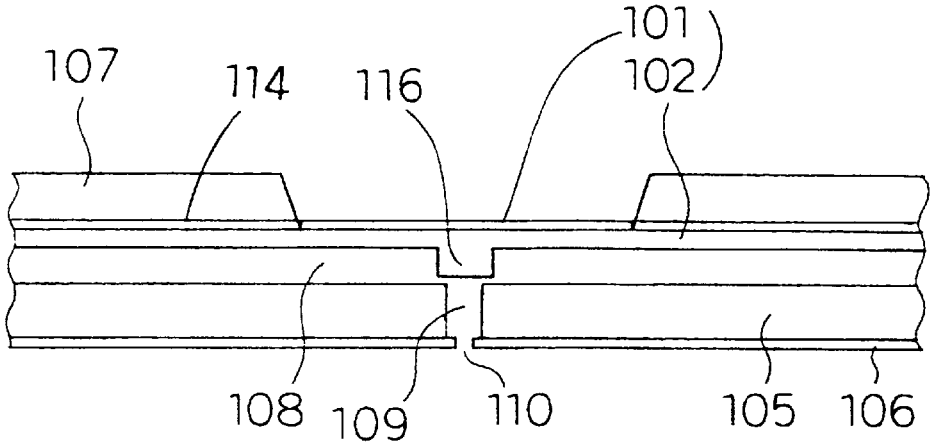
FIGS. 10(*a*)–10(*b*) is a view showing a liquid injection device according to an eleventh embodiment of the present invention.
Figure 10B:
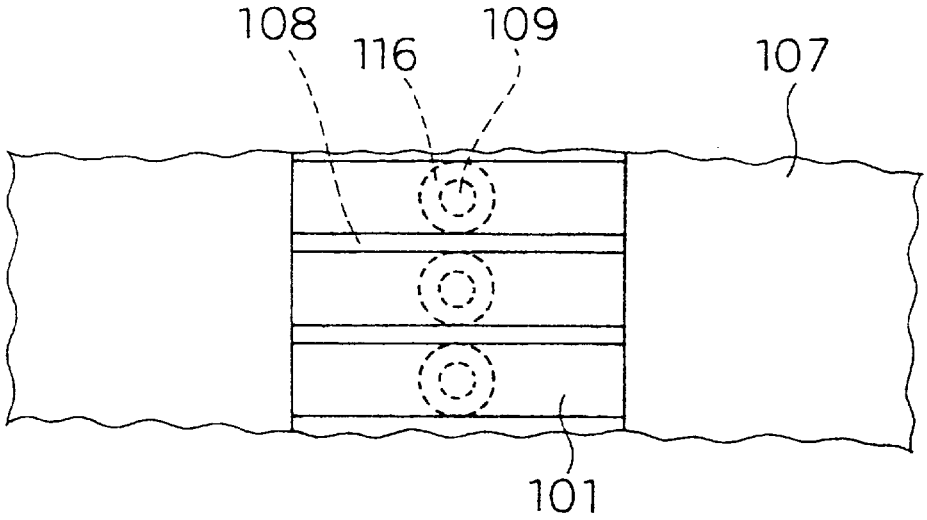

The description will be made of an eleventh embodiment of a liquid injection device according to the present invention with reference to FIG. 10. Since the dimensions of the present embodiment are generally the same as in the fourth embodiment, only a portion particularly greatly different will be described. The diaphragm 102 has a thickness of 40 $\mu$m in portions other than its central portion, and has, in the central portion, a cylindrical column-shaped projection 116 having a diameter of 200 $\mu$m and a height of about 100 $\mu$m. Also, the liquid passage 108 has a depth of about 120 $\mu$m.

The liquid injection method in the liquid injection device according to the present embodiment is generally the same as in the fourth embodiment. The features of the present embodiment are, unlike the fourth embodiment, that there is a projection in the central portion of the diaphragm 102, and the rigidity in this portion is high, and that there is no partitioning portion 112 in the liquid pressurizing chamber. By increasing the rigidity in the central portion, the deformation of the piezo-electric actuator 103 due to the reaction from the liquid pressurizing chamber 109 is reduced, and the effect of hermetically sealing the liquid pressurizing chamber 109 pressure-wise is further enhanced. Therefore, the pressure response characteristic is improved. Also, since the partitioning portion 112 in the liquid pressurizing chamber is eliminated, it becomes possible to easily form the liquid pressurizing chamber 109 portion by etching or the like, making it possible to reduce the cost.

Twelfth Embodiment

Figure 11A:
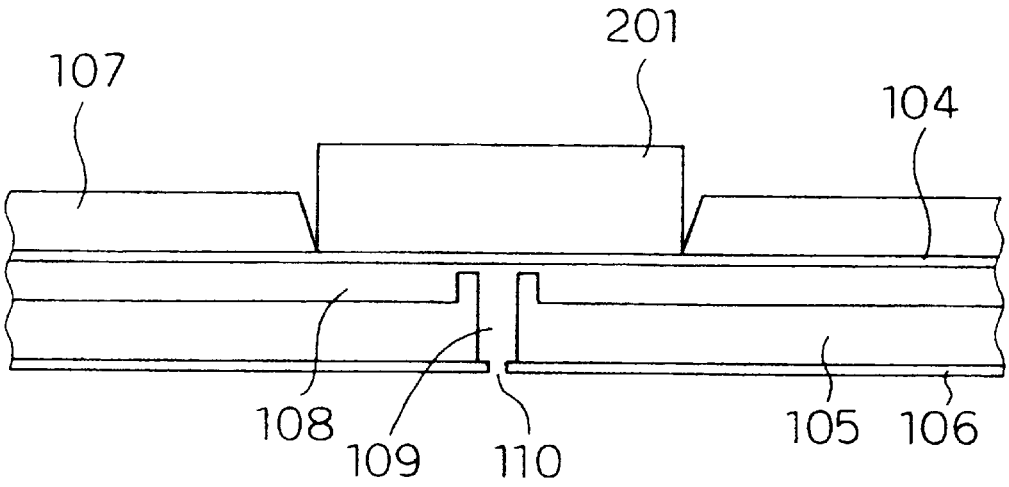
FIGS. 11(*a*)–11(*b*) is a view showing a liquid injection device according to a twelfth embodiment of the present invention.
Figure 11B:
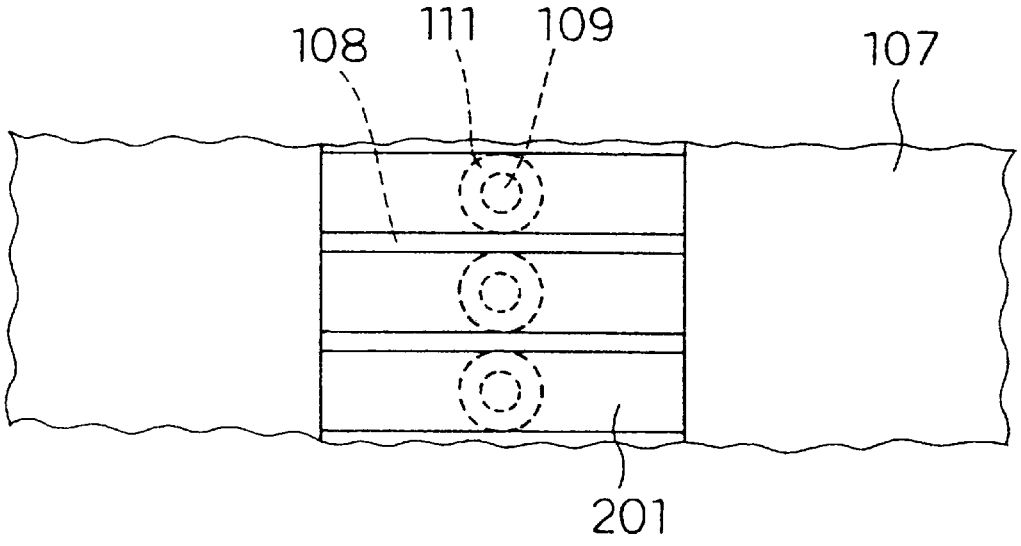

The description will be made of a twelfth embodiment of a liquid injection device according to the present invention with reference to FIGS. 11 and 19. Since the dimensions of the present embodiment are generally the same as in the fourth embodiment, only a portion particularly greatly different will be described.

In the present embodiment, the pies-electric actuator 103 according to the fourth embodiment is replaced with a laminating type actuator 201. The description will be made of the structure and principle of operation of the laminating type actuator 201 with reference to FIG. 19. FIG. 19(*a*) is a perspective view showing the laminating type actuator 201, which is configured by a plurality of piezo-electric substrates, which take the length-wise vibration mode described in the first embodiment, superimposed. FIG. 19(*b*) is a top view, and FIG. 19(*c*) is a front view. In FIG. 19(*c*), the broken lines indicate a state of deformation of the laminating type actuator 201 when plus voltage is applied across the electrodes 620*a*–620*b*. FIG. 19(*d*) is also a front view, and the broken lines indicate likewise a state of deformation when minus voltage is applied. Actually, the laminating type actuator 201 does not become deformed upward in the upper side FIGS. 19(*c*) and 19(*d*), but becomes deformed that much more downward because its upper portion, that is, the upper side portion of the top view FIG. 19(*b*) is fixed by the holding substrate 107. The laminating type actuator which takes such length-wise vibration mode has remarkably higher flexural rigidity than the piezo-electric actuator of flexing vibration mode which has been described in the first embodiment.

The reason why the laminating type is adopted in this manner will be described. By making the thickness of the piezo-electric substrate per piece thinner, an electric field to be applied to the piezo-electric element is make greater, and by laminating in an amount corresponding to the reduced thickness and the deteriorated rigidity, the rigidity is enhanced to make the generating force of the actuator higher.

The injection method of the liquid injection device according to the present embodiment is generally the same as the fourth embodiment.

The feature of the liquid injection device according to the present embodiment is that the piezo-electric actuator 103, which has been used as liquid pressurizing means in the fourth embodiment, is replaced with a laminating type actuator 201. The laminating type actuator 201 is excellent in pressure response characteristic and high-frequency characteristic because it has higher rigidity than the piezo-electric actuator 103 although it has smaller generated displacement. Therefore, it is suitable for injecting comparatively small liquid drops. Because of the above-described feature, it goes without saying that multi-tone printing can be made, and it further becomes possible to inject small-diameter liquid, and high-resolution printing can be also made.

Thirteenth Embodiment

Figure 13:
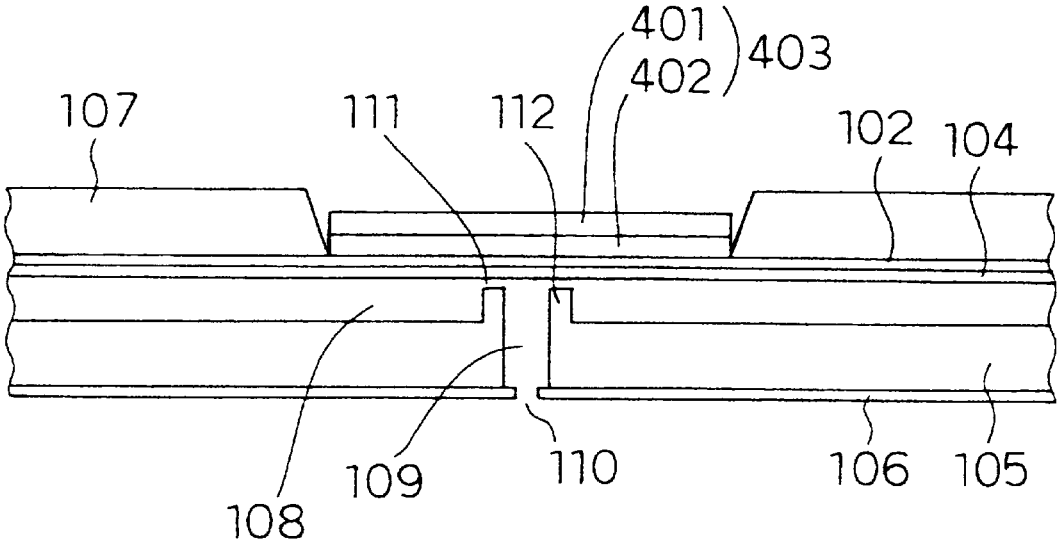
FIG. 13 is a view showing a liquid injection device according to a thirteenth embodiment of the present invention.

The description will be made of a thirteenth embodiment of a liquid injection device according to the present invention with reference to FIG. 13. Since the dimensions of the present embodiment are generally the same as in the fourth embodiment, only a portion particularly greatly different will be described.

In the present embodiment, the piezo-electric actuator 103 in the fourth embodiment is placed with a bimorph type piezo-electric single-crystal actuator 403. The structure of the bimorph type piezo-electric single-crystal actuator 403 will be described with reference to FIG. 13. Each single-crystal lithium niobate substrate 401, 402 has a thickness of 25 $\mu$m. Also, the single-crystal lithium niobate substrate 401, 402 is polarized in a direction opposite to the thickness-wise direction of the substrate as shown in FIG. 16(*a*). Normally, a single-crystal lithium niobate is polarized in the Z-axis direction of the crystal, that is, c-axis direction. As regards the single-crystal lithium niobate substrate 401, 402, when y-axis is rotated by 140° with x-axis as a rotating shaft and it is newly assumed to be y'-axis, and at the same time, z-axis is also rotated by 140° and it is assumed to be z'-axis as shown in FIG. 16(*c*), it is a substrate obtained by cutting so as to set the y'-axis in the direction of the normal. In other words, the single-crystal lithium niobate substrate 401, 402 is a substrate cut as shown in FIG. 16(*d*). When these substrates 401 and 402 are pasted together with the reverse sides thereof put together, a substrate having such a direction of polarization as shown in FIG. 16(*a*) is obtained. Also, as shown in FIG. 16(*b*), the substrates may be cut and pasted together so that the direction of polarization is set to an angle of 80° instead of the complete opposite direction.

In the present embodiment, the lithium niobate substrate 401, 402 is obtained by cutting an ingot polarized in a predetermined azimuth at the above-described cutting angle, and thereafter, directly joining in accordance with the process described in the ninth embodiment to further form electrodes on the upper and lower surfaces. Also, since it has a property that it expands and contracts in the longitudinal direction of the substrate when pulse voltage is applied in the thickness-wise direction of the substrate, when the lithium niobate substrate 401 has expansion displacement by pasting together after polarization and inversion, the lithium niobate substrate 402 has contraction displacement, and it is possible to constitute a bimorph type piezo-electric single-crystal actuator 403 which takes a flexing vibration mode.

A liquid injection device according to the present embodiment is constructed such that the bimorph type piezo-electric single-crystal actuator 403 described above is bonded to a diaphragm 102 with a thickness of 3 $\mu$m, and its other portions are generally the same as in the fourth embodiment. However, the diaphragm 102 is not always necessary, but in the present embodiment, the diaphragm 102 and the back electrode of the bimorph type piezo-electric single-crystal actuator 403 are brought into conduction on bonding, and the diaphragm 102 is used only to use it as a common electrode. Also, although not specified in the figure, the upper surface of the lithium niobate substrate 401, that is, the surface on the opposite side to the lithium niobate substrate 402 is provided with an electrode, and the electrode is further brought out outside.

The injection method in a liquid injection device according to the present embodiment is generally the same as in the fourth embodiment.

The feature of the liquid injection device according to the present embodiment is that the piezo-electric actuator 103, which has been used as liquid pressurizing means in the fourth embodiment, is replaced with a bimorph type piezo-electric single-crystal actuator 403. This further provides the following effects in addition to the effects described in the ninth embodiment. Firstly, it is possible to obtain a large displacement amount by a low electric field, and to improve the dielectric strength of the actuator. Secondly, since thermal expansion is performed using the same material, it is possible to simplify the process of direct joining, and the cost can be reduced.

Fourteenth Embodiment

Figure 12B:
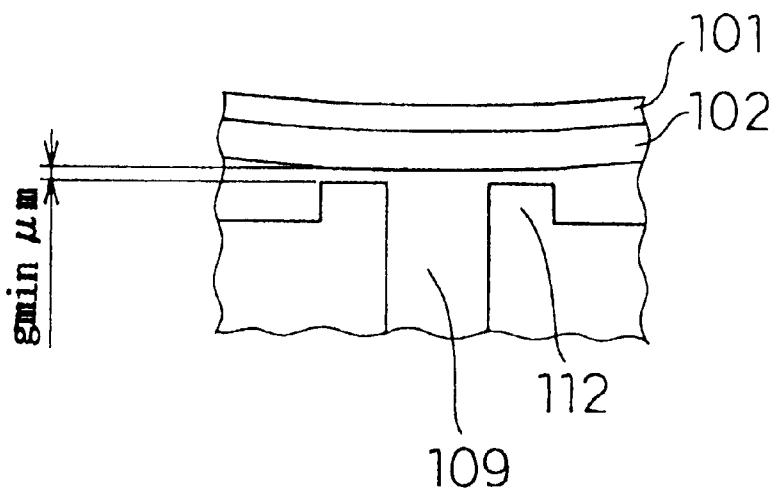
FIGS. 12(*a*)–12(*b*) is a view showing an aspect of a liquid injection device.
Figure 12A:
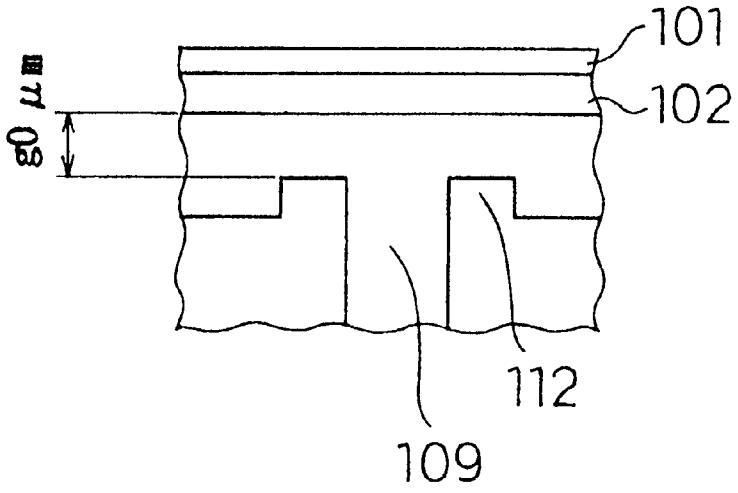
Figure 14A:
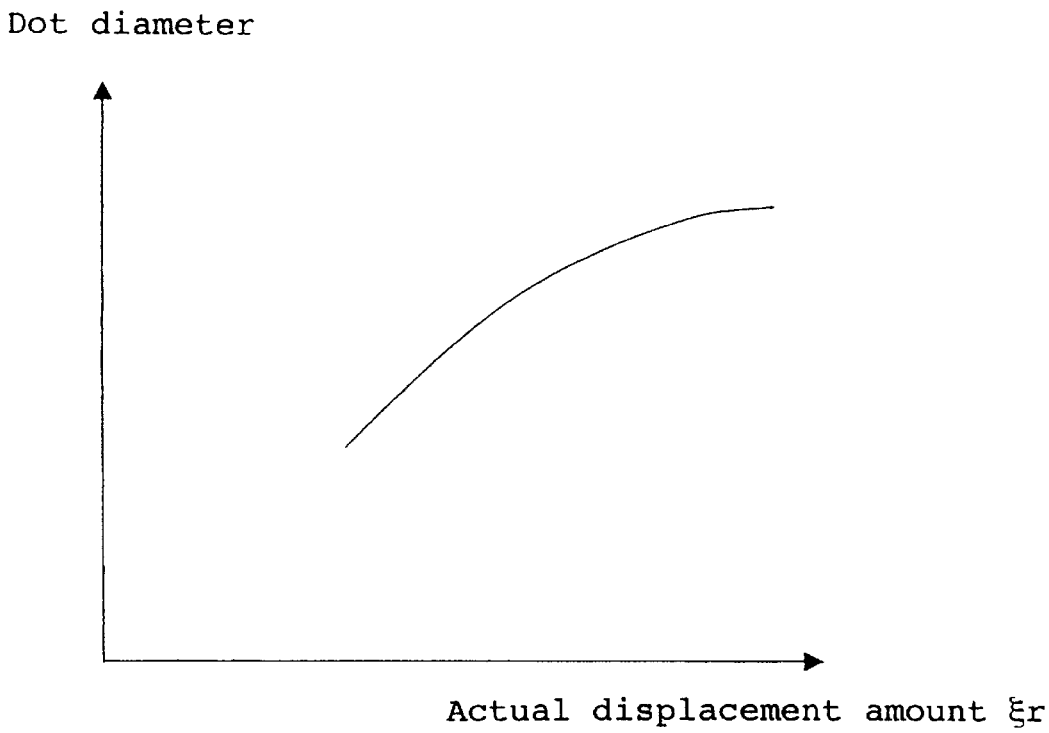
FIGS. 14(*a*)–14(*b*) is a view showing relation between a virtual displacement amount and a dot diameter.
Figure 14B:
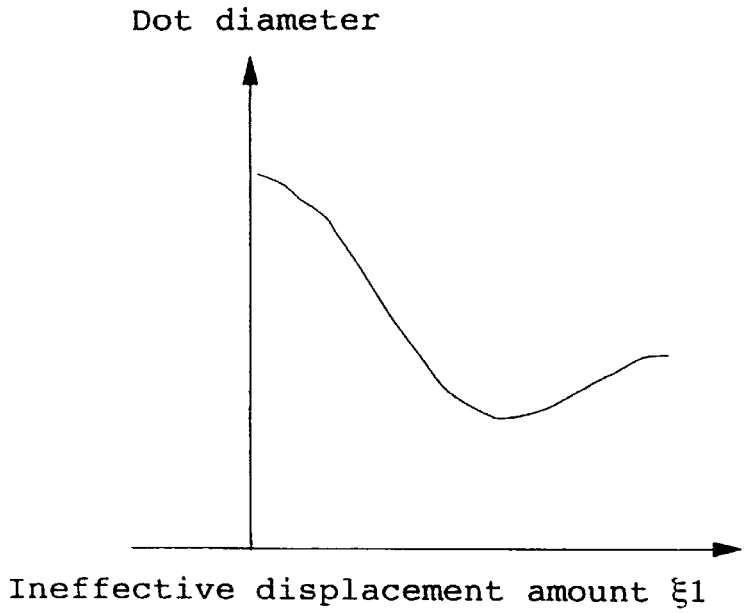

The description will be made of a fourteenth embodiment of a liquid injection device according to the present invention with reference to FIGS. 5, 12 and 14. The present embodiment relates to the liquid injection method in a liquid injection device having such a structure as described in, for example, the first embodiment or the fourth embodiment or such a structure as described in the twentieth embodiment to be described later, and the detailed description will be made of the liquid injection method on performing dot modulation. FIG. 12 is an enlarged view showing the vicinity of a liquid pressurizing chamber 109, FIG. 12(*a*) is a view showing a state when no voltage is applied, and FIG. 12(*b*) is a view showing a state when the piezoelectric actuator 103 is brought closest to the partitioning portion 112 in the liquid pressurizing chamber when voltage is applied. However, the resin sheet 104 is omitted, and actually, the initial interval g0 is a distance between the lowest portion of the resin sheet 114 and the highest portion of the partitioning portion 112 in the liquid pressurizing chamber. The same is the case with the minimum interval gmin. FIG. 14 shows the relation between actual displacement amount $\xi r$ and injection liquid drop amount of the piezo-electric actuator 103.

The structure of the liquid injection device according to the present embodiment is the same as in the fourth embodiment.

The injection method in a liquid injection device according to the present embodiment is basically predicated on the injection methods described in the first and fourth embodiments. By changing the displacement amount ξr of the piezoelectric actuator 103, the liquid drop amount to be injected on paper is controlled. In, for example, the injection method according to the present embodiment, when ξr is changed by controlling the voltage, dot modulation of 8 to 16 value can be performed. In this case, it becomes possible to control the injection liquid drop amount at excellent reproducing ability within a range of ±2% if at the same input voltage value. Also, even at the same applied voltage, it is possible to change the actual replacement ξr by changing the initial interval g0, dot modulation of 8 to 16 value can be performed, and the dot reproducing ability also falls within the range of ±2%. In this respect, as a method of changing g0, an embodiment ? or the like to be described later can be used. Also, by changing both the applied voltage and the initial interval g0 in combination, dot modulation of 16 to 32 value can be performed, and the dot reproducing ability also falls within the range of ±2%.

The features of the liquid injection method according to the present embodiment are to control the actual displacement amount, to control the pressure within the liquid pressurizing chamber 109, and to control the injection liquid drop amount to be recorded. These features provide the effect that it becomes possible to control the injection liquid drop amount accurately and at excellent reproducing ability by a simple method of changing the input voltage value.

The displacement amount of the actuator 103 will be described. When the initial interval g0 is sufficiently large as compared with the maximum displacement amount ξmax of the piezo-electric actuator 103, the reaction which the piezo-electric actuator 103 undergoes from the liquid pressurizing chamber 109 (including the partitioning portion 112 in the liquid pressurizing chamber, and so forth) is comparatively low, and becomes an almost constant value. This state is defined as a free state. In the free state, when the same driving waveform is applied, the displacement amount of the piezo-electric actuator 103 becomes the substantially same value irrespective of g0. If, however, the initial interval g0 is a value close to the maximum displacement amount ξmax, the reaction which it undergoes from the liquid pressurizing chamber 109 becomes higher toward the partitioning portion 112 in the liquid pressurizing chamber, and the piezo-electric element comes to a standstill, surpassed by the reaction in the course of time. This state is defined as a rate-determining state. In the rate-determining state, assuming the displacement amount of the piezo-electric actuator 103 from the initial position before voltage is applied, to be an actual displacement amount ξr, and assuming a displacement amount when the same voltage is applied in the free state, to be ξf, a displacement amount for ξf−ξr is to be reduced by the reaction undergoing from the liquid pressurizing chamber 109. When the displacement amount reduced is assumed to be ξ1, ξ1=ξf−ξr. This ξ1 is defined to be an ineffective displacement amount. ξ1 can be changed by changing the initial interval g0. In other words, ξr is also changed by g0, and it becomes possible to change the size of the injection liquid drop amount by means of g0. The relation between the ineffective displacement amount and the injection liquid drop amount can be expressed as shown in FIG. 14(*b*).

Fifteenth Embodiment

The description will be made of a fifteenth embodiment of a liquid injection device according to the present invention with reference to FIG. 15. The present embodiment further makes the liquid injection method described in the fourteenth embodiment more effective, and the liquid injection method on performing dot modulation will be described in detail.

The liquid injection method according to the present embodiment changes a period of time from a time at which the piezo-electric actuator 103 starts the displacement in a direction to reduce the interval g to a time at which the piezo-electric actuator 103 is brought closest to the partitioning portion 112 in the liquid pressurizing chamber, that is, changes the operating speed of the piezo-electric actuator 103. This changes the pressure within the liquid pressurizing chamber 109 to thereby control the amount of liquid to be injected. FIG. 15 shows the relation between the actual displacement amount ξr, the actuator operating speed v and the injection liquid drop amount based on the injection method according to the present embodiment.

Figure 15A:
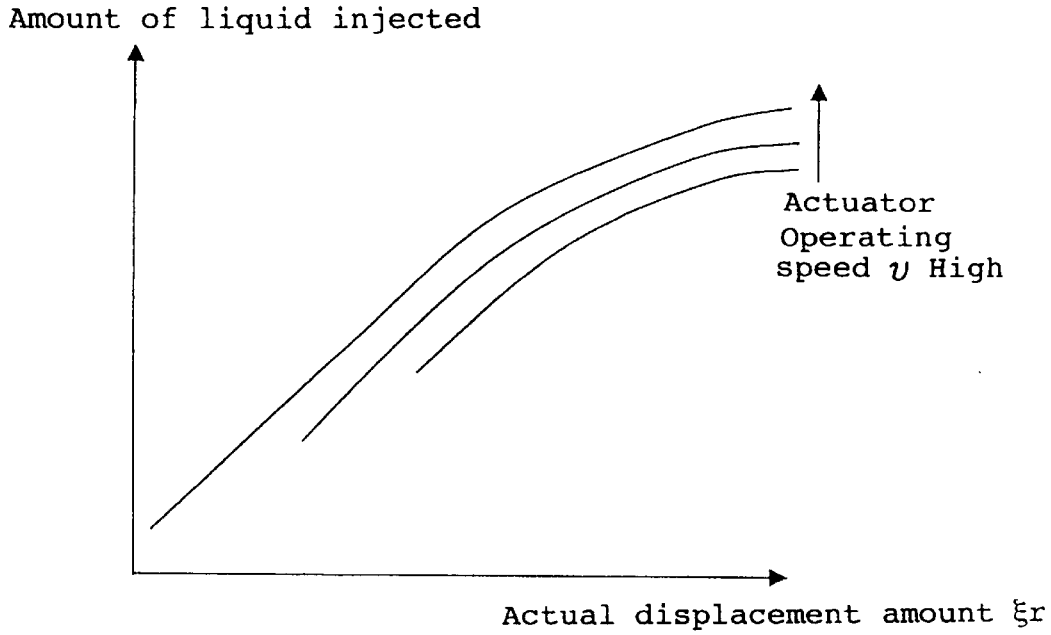
FIGS. 15(*a*)–15(*b*) is a view showing relation between a virtual displacement amount and a dot diameter when the driving speed of an actuator is changed.
Figure 15B:
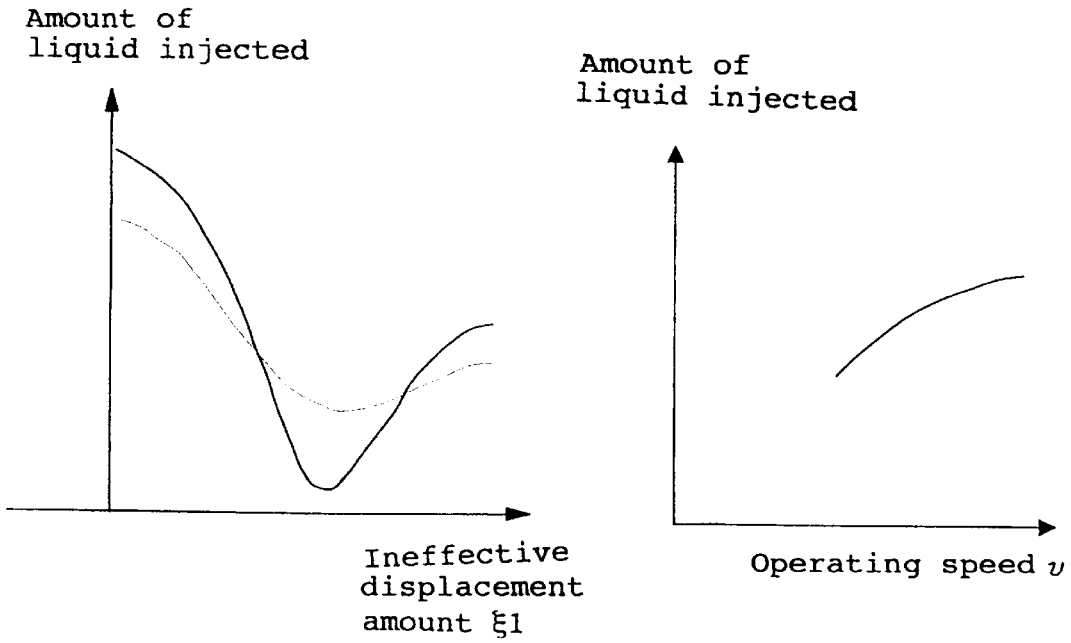
Figure 16B:
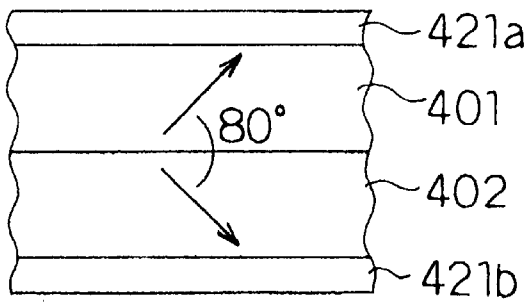
FIGS. 16(*a*)–16(*b*) is a view showing the structure of a piezo-electric single crystal.
Figure 16A:
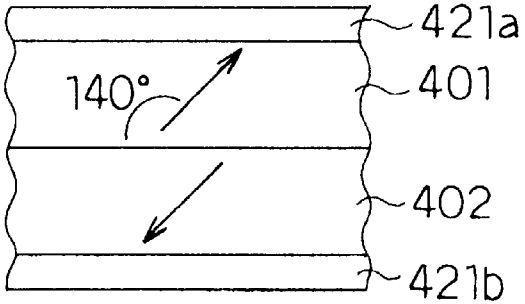
Figure 16D:
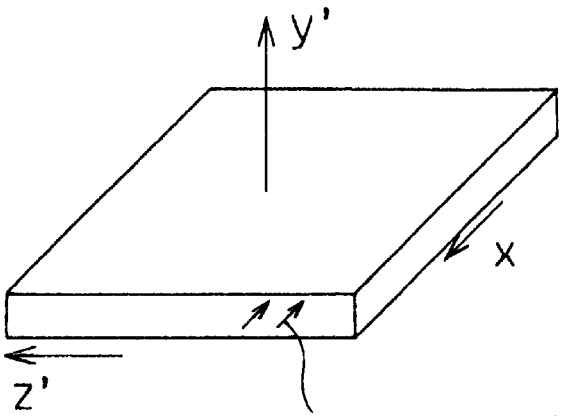
Figure 16C:
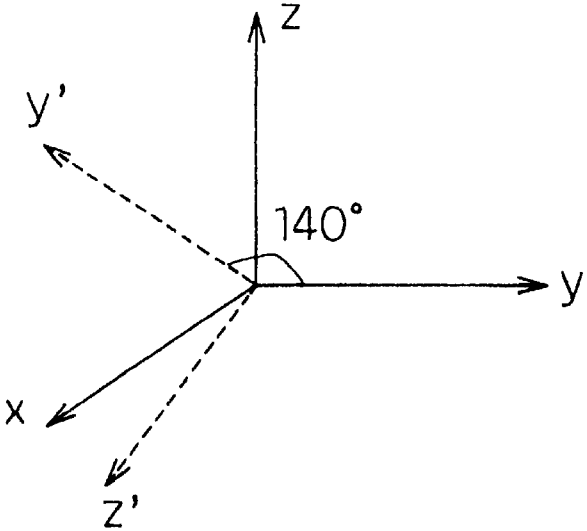

This method enables smaller injection liquid drop amount to be obtained than the method described in the fourteenth embodiment as shown in FIG. 15, and as a result, the modulation width is widened to increase the number of controllable gradation levels. When a liquid injection device having the structure described, for example, in the fourth embodiment is used, a number of gradation levels of 32 value or more can be obtained by the liquid injection method according to the present embodiment, and it becomes possible to control the injection liquid drop amount at excellent reproducing ability within a range of ±2% if at the same input voltage waveform.

Because of the features of the liquid injection method described above, it becomes possible to greatly improve the modulation width by changing the actual displacement amount ξr and operating speed v of the piezo-electric actuator 103, and there is the effect that more multi-tone printing can be implemented.

In this respect, the relation between the ineffective displacement amount ξ1 and the injection liquid drop amount in the injection method according to the present embodiment becomes as shown in FIG. 15(*b*). The broken lines in the figure indicate a case in which the injection method described in the fourteenth embodiment is used, and the modulation width is increased.

In this respect, in the injection method according to the present embodiment, both the actual displacement amount ξr and actuator operating speed v have been made variable, but naturally, the dot modulation can be performed even if only the actuator operating speed is changed. FIG. 15(*c*) shows its state. The abscissa represents the operating speed v and the ordinate represents the liquid injection amount.

Sixteenth Embodiment

The description will be made of a sixteenth embodiment of a liquid injection device according to the present invention with reference to FIGS. 12 and 14. The present embodiment relates to the liquid injection method in a liquid injection device having the structure described in the fourth or first embodiment, and the liquid injection method for obtaining high energy utilization efficiency.

The structure of the liquid injection device according to the present embodiment is the same as in the fourth embodiment.

The description will be made of the liquid injection method according to the present embodiment. As described in the first or fourth embodiment, immediately before the liquid is injected through the liquid injection port 110, the pressure within the liquid pressurizing chamber 109 becomes a maximum. At this time, the interval g becomes gmin. In order to enhance the energy utilization efficiency, it is ideal that the pressure within the liquid passage 108 is constant irrespective of the displacement state of the piezo-electric actuator 103 and that an increase in pressure occurs only in the liquid pressurizing chamber 109. In the present embodiment, a ratio of pressure in the liquid pressurizing chamber 109 to that in the liquid passage 108 is set to five or more times, and the number of gradation levels of 8 value or more is implemented. Assuming the pressure within the liquid pressurizing chamber 109 to be P2, and that within the liquid passage 108 to be P1, a condition of P2/P1 >5 is required. The reaction undergone by the piezo-electric actuator, which is a value obtained by integrating the pressure with respect to the area, preferably satisfies relation of A2/A1>½ assuming a reaction in the liquid pressurizing chamber 109 to be A2, and a reaction in the liquid passage 108 to be A1.

The feature of the liquid injection method according to the present embodiment is to raise the pressure within the liquid pressurizing chamber 109 to more than five times as high as the pressure within the liquid passage 108. This raises the energy utilization efficiency, enables the number of gradation levels of 8 value or higher to be implemented and enables multi-tone printing. In this respect, in order to enable sufficiently-high image quality color printing, the number of gradation levels of 16 value or higher is preferably required, and the number of gradation levels of 32 value or higher can be implemented by combining with the fourteenth or fifteenth embodiment.

In this respect, in the present embodiment, the relation of P2/P1>5 was adopted, and even at a ratio less than it, the present embodiment is higher in the energy utilization efficiency than that in an ordinary piezo-electric liquid injection device. If the liquid is injected under a condition of, for example, P2/P1>2, it becomes higher in the energy utilization efficiency than the comparative example.

Seventeenth Embodiment

Figure 27A:
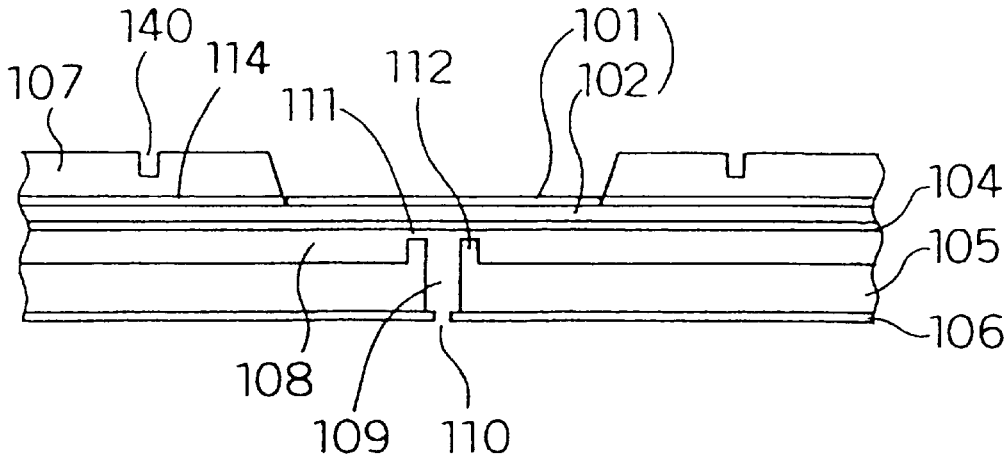
FIGS. 27(*a*)–27(*b*) is a view showing a liquid injection device according to a seventeenth embodiment of the present invention.
Figure 27B:
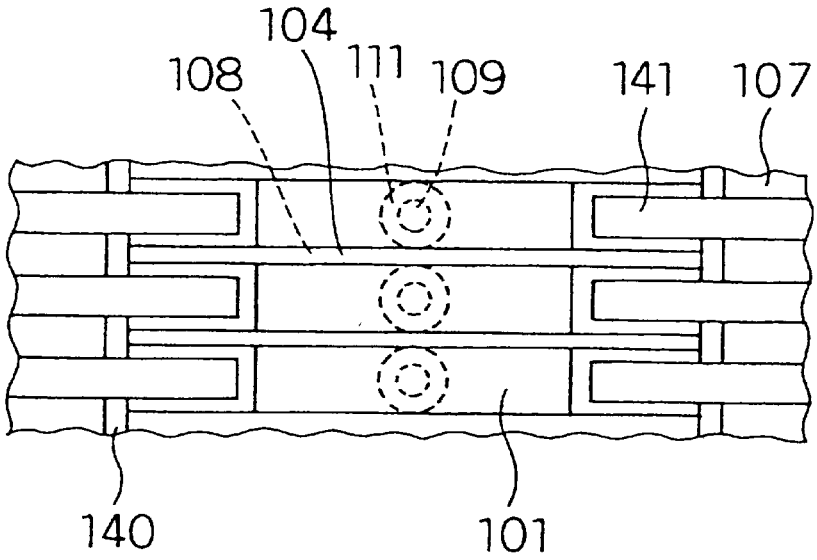

The description will be made of a seventeenth embodiment of a liquid injection device according to the present invention with reference to FIGS. 12 and 27. The present embodiment relates to the liquid injection method in a liquid injection device having the structure described in the fourth or first embodiment.

As described in the fourteenth embodiment, the initial interval g0 is an important parameter for determining the liquid injection characteristic. If, for example, the initial interval g0 differs between elements, there arises also a problem that the dot diameter differs even if the same voltage value is applied. Also, there arises a problem that the expected performance of the liquid injection device cannot be obtained because the liquid injection device manufactured deviates from the g0 designed. The problem can be solved by improving the accuracy in the manufacture, but there also arises a defect that the manufacturing cost will be expensive.

The description will be made of the structure of a liquid injection device for performing the liquid injection method according to the present embodiment. In FIG. 27, a reference numeral 140 denotes a groove provided on a holding substrate 107; and 141, an electromagnetic type actuator provided to cause a holding substrate 107 on the side of the piezo-electric actuator 103 to become deformed. Also, the holding substrate 107 is machined into such a shape that its portion on the side of the piezo-electric actuator 103 is cut apart from the groove 140 for each liquid injection element as shown in FIG. 27(*b*).

Next, the description will be made of the liquid injection method according to the present embodiment. When the electromagnetic type actuator 141 is caused to become deformed, the piezo-electric actuator 103 becomes deformed in accordance with an amount of deformation of the electromagnetic type actuator 141. In other words, g0 is to change. The electromagnetic type actuator 141 is caused to become deformed so that g0 becomes a predetermined size in this manner, and further predetermined driving voltage for driving the piezo-electric actuator 103 under pressure and driving under a reduced pressure is applied to inject the liquid. In this respect, the deformation of the piezo-electric actuator 103 caused by the electromagnetic type actuator 141 may be performed before driving voltage for driving the piezo-electric actuator 103 under pressure and under a reduced pressure is applied, and may be performed while the driving voltage is being applied.

Through the use of the liquid injection method described above, it becomes possible to eliminate variations between elements at the actual initial interval g0 and deviation from a desired amount, and the following effects are provided. Firstly, it becomes possible to accurately control the interval g, to improve the reproducing ability for the dot diameter, and finer multi-tone printing can be implemented. Secondly, the required accuracy in the manufacture is relaxed, and it becomes possible to restrain the manufacturing cost low.

In this respect, for the deformation of the holding substrate 107, a piezo-electric actuator or another actuator may be used in addition to the electromagnetic type actuator used in the present embodiment. It is essential that the member be capable of causing the holding substrate 107 to become deformed by a desired amount.

Eighteenth Embodiment

The description will be made of an eighteenth embodiment of a liquid injection device according to the present invention. The present embodiment relates to the liquid injection method in a liquid injection device having the structure described in the fourth or first embodiment.

As described in the fourteenth and seventeenth embodiments, the initial interval g0 is an important parameter for determining the liquid injection characteristic, and adjustment on the order of $\mu$m becomes necessary.

In the liquid injection method according to the present embodiment, in addition to the driving voltage for driving the piezo-electric actuator 103 under pressure and under a reduced pressure, DC voltage is superimposed on the driving voltage for driving the piezo-electric actuator 103 in order to control the initial interval g0. Thus, it becomes possible to eliminate variations between elements at the actual initial interval g0 and deviation from a desired amount. The above-described features provide the same effects as described in the seventeenth embodiment, and in addition, provide the following effects. Firstly, since the piezo-electric actuator 103 is directly caused to become deformed, that is, is caused to become deformed by DC voltage to thereby actually control g0, it becomes possible to further accurately control the interval g, to further enhance the reproducing ability for dot diameter and to implement finer multi-tone printing. Secondly, there is no need for any new actuator requiring complicated machining of the holding substrate 107 and for controlling g0, and it becomes possible to restrain the manufacturing cost low.

In this respect, the bias voltage to be superimposed need not be applied to the piezo-electric actuator 103 at all times, but is preferably applied during pressurizing operation thereof. More specifically, applying time for the bias voltage must be limited to time with such a degree that the piezo-electric actuator 103 does not return to its original state.

In this respect, as a DC bias applying mechanism, a resistor is provided by printing on an outgoing-electrode portion connected to a top face electrode of the piezo-electric actuator 103 for each element, and the resistance value is changed by laser trimming, whereby it is possible to easily change bias value applied to each element. Also, voltage waveform to be applied may be stored on a semiconductor memory.

Nineteenth Embodiment

The description will be made of a manufacturing method according to a nineteenth embodiment of the present invention with reference to FIGS. 3 and 4. A piezo-electric actuator 103 is manufactured as shown in FIG. 4 using a similar method to the first embodiment. Next, each member in FIG. 3 is superimposed and screws are inserted into tapped holes provided in advance to fix each member.

In this respect, the feature of the manufacturing method described above is that no adhesive is used to fix the members. In the case of a liquid injection device having such a structure as, for example, in the first or fourth embodiment, an initial interval g0 between the piezo-electric actuator 103 (actually resin sheet 104) and the partitioning portion 112 in the liquid pressurizing chamber becomes a very important parameter, on which the liquid injection characteristic is dependent. If the members are fixed using adhesive, it will become difficult to control g0, and variations in g0 between elements will be large. These result from variations in thickness of the adhesive and warpage after the bonding among others. The warpage after the bonding occurs because of, for example, a difference in thermal expansion coefficient of the base material or the like. Through the use of the manufacturing method according to the present embodiment, the problem can be solved. Therefore, it becomes possible to manufacture a liquid injection device which need no adjustment of g0 and has hardly variations in characteristic between elements.

Twentieth Embodiment

Figure 28A:
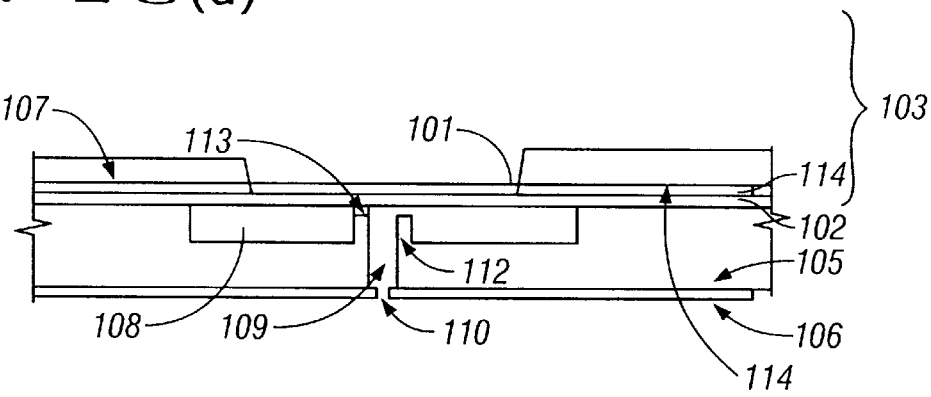
FIGS. 28(*a*)–28(*b*) is a view showing a liquid injection device according to a twentieth embodiment of the present invention.
Figure 28B:
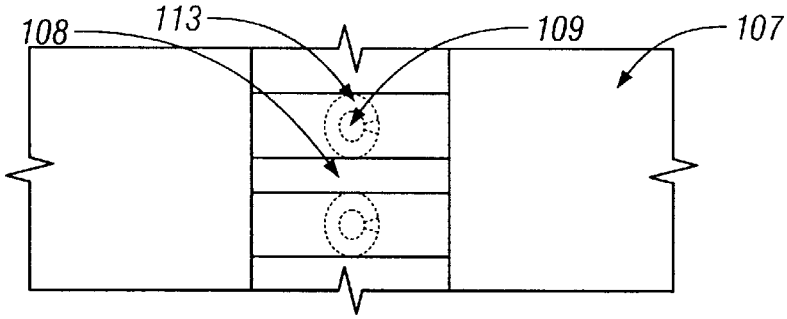
Figure 29:
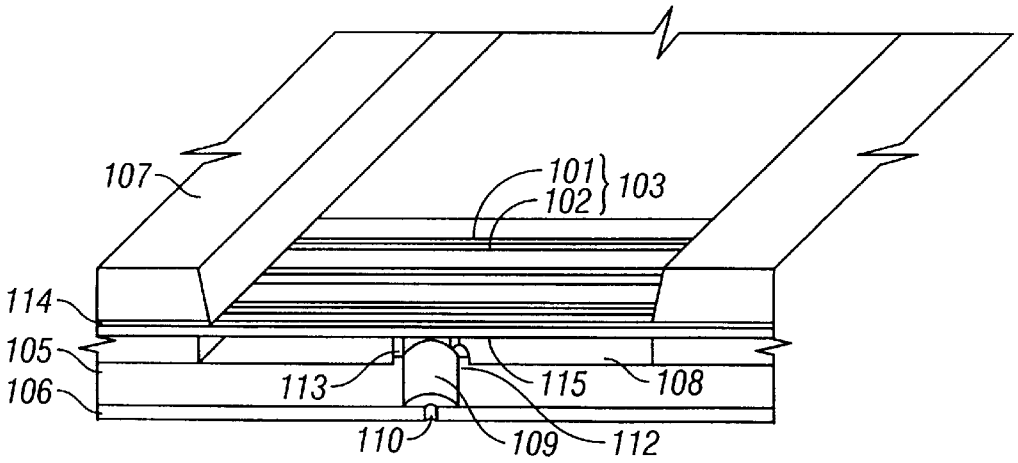
FIG. 29 is a view showing a liquid injection device according to a twentieth embodiment of the present invention.

The description will be made of a first embodiment of a liquid injection device according to the present invention with reference to FIGS. 28 and 29. FIG. 28(*a*) is a cross-sectional view showing one element of a liquid injection device according to the present embodiment, and FIG. 28(*b*) is a top view showing a part of the liquid injection device according to the present embodiment, in which two liquid injection elements of the liquid injection device are shown. FIG. 29 is a perspective view for the liquid injection device. The actual liquid injection device is configured by a plurality of liquid injection elements lined. The reference numerals in the figures have the same meanings as those described in the above-described embodiments. However, a reference numeral 113 denotes a low-rigidity layer, and is a resin layer having lower coefficient of elasticity than, for example, the liquid passage 108 and the piezo-electric actuator 103.

Next, the description will be made of the structure and dimensions of the liquid injection device according to the present embodiment. The piezo-electric substrate 101 and the diaphragm 102 are bonded together with adhesive. The piezo-electric substrate 101 has 45 $\mu$m in thickness, 2.5 mm in length, and 200 $\mu$m in width. The actuator portion of the diaphragm 102 has 105 $\mu$m in thickness and the same length and width as the piezo-electric substrate 101. Also, a gap between the liquid injection elements which are adjacent each other is the same as in the first embodiment. The piezo-electric actuator 103 is, at its both ends, supported by the holding substrate 107, and in addition, is supported even on the upper surface of the partitioning portion 112 in the liquid pressurizing chamber through the low-rigidity layer 113.

The low-rigidity layer 113 is a resin layer with a thickness of 30 $\mu$m, and its coefficient of elasticity is one tenth or less that of material constituting the piezo-electric actuator 103 or the substrate 105 for formation of the liquid chamber. Normally, the coefficient of elasticity of the low-rigidity layer 113 is one fifth or less that of the piezo-electric actuator 103, and is preferably one tenth or less. The liquid passage 108 has a length of 2.5 mm and a depth of 200 $\mu$m Also, the liquid pressurizing chamber 109 has inside dimensions: cross-sectional diameter of 140 $\mu$m and a depth of 400 $\mu$m. The upper surface of the partitioning portion 112 in the liquid pressurizing chamber has dimensions: an outer diameter of 200 $\mu$m and an inner diameter of 140 $\mu$m. The substrate 106 for formation of the injection port has a thickness of 30 $\mu$m, and the aperture diameter of the injection port 110 is 30 $\mu$m. Also, the substrate 105 for formation of the liquid chamber and the substrate 106 for formation of the injection port are bonded together with adhesive.

In the liquid injection device according to the present embodiment, although not clearly shown in the figure for brevity, electrodes on the upper surface of each liquid injection element are brought out to an electrode leading pad which has been provided in advance on the holding substrate 107 by wire bonding.

The manufacturing method for a liquid injection device according to the present embodiment is generally the same as in the first embodiment, but a process of coating the partitioning portion 112 in the pressurizing chamber with low-rigidity resin is added.

The liquid injection method according to the present embodiment is generally the same as in the first and fourth embodiments, but is different in the following points. When the piezo-electric actuator 103 is bent and displaced downward, contracted deformation appears in the low-rigidity layer 113, and the pressure within the liquid pressurizing chamber 109 rises to inject the liquid through the liquid injection port 110. Since the piezo-electric actuator 103 and a part of the partitioning portion 112 in the pressurizing chamber are bonded through the low-rigidity layer 113, the displacement amount of the piezo-electric actuator 103 becomes smaller than in the fourth embodiment if they are of the same shape at the same applied voltage, and pressure leakage from the liquid pressurizing chamber 109 to the liquid passage 108 becomes also smaller.

If a liquid injection device according to the present embodiment described above is used, the number of controllable gradation levels becomes 4 to 8 value, and larger than in the conventional piezo-electric type. Also, the minimum injection liquid drop amount becomes smaller than in the fourth embodiment.

Next, the description will be made of the features and effects of a liquid injection device according to the present embodiment. The features of the liquid injection device according to the present embodiment are that firstly, the area of the piezo-electric actuator 103 is larger than the cross-sectional area (area of the liquid pressurizing chamber 109 in FIG. 1(*b*)) of the liquid pressurizing chamber 109, and that secondly, the structure is arranged such that pressure is concentrated in the liquid pressurizing chamber 109. The same effect as the fourth embodiment can be obtained resulting from the first feature, and further in addition, it becomes more advantageous to inject small liquid drops due to the second effect.

In this respect, in the present embodiment, the low-rigidity layer 113 shaped like a cylinder is partly lacking, and the liquid flows into the pressurizing chamber 109 through the lacking portion. It may be possible to make this low-rigidity layer 113 into a perfect cylinder, and to form a hole (aperture) on the side surface of the partitioning portion 112 in the liquid pressurizing chamber in place of eliminating the lacking portion in such a manner that the liquid can flow into the pressurizing chamber 109 through the hole.

In this respect, the lacking portion for liquid flowing described above is provided at one place in the present embodiment, but a plurality of holes may be provided.

Twenty-first Embodiment

Figure 30A:
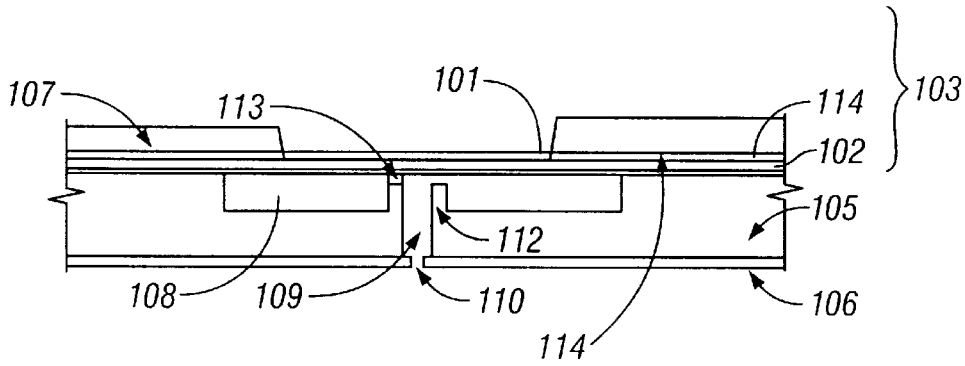
FIGS. 30(*a*)–30(*b*) is a view showing a liquid injection device according to a twenty-first embodiment of the present invention.
Figure 30B:
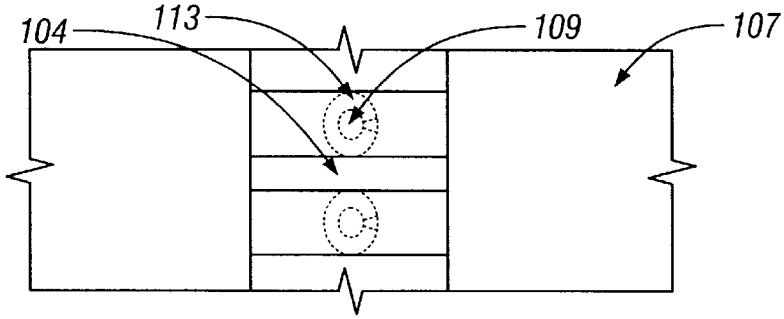

The description will be made of a twenty-first embodiment of a liquid injection device according to the present invention with reference to FIG. 30. FIG. 30(*a*) is a cross-sectional view, and FIG. 3(*b*) is a top view. Also, the liquid injection device according to the present invention is constructed, in addition to the structure of the twentieth embodiment, such that the resin sheet 104 described in the second embodiment is inserted.

The injection method according to the present embodiment is generally a combination of the twentieth ad second embodiments.

Through the use of the liquid injection device according to the present invention described above, the effects described in the twentieth and second embodiments can be obtained.

Twenty-second Embodiment

Figure 31A:
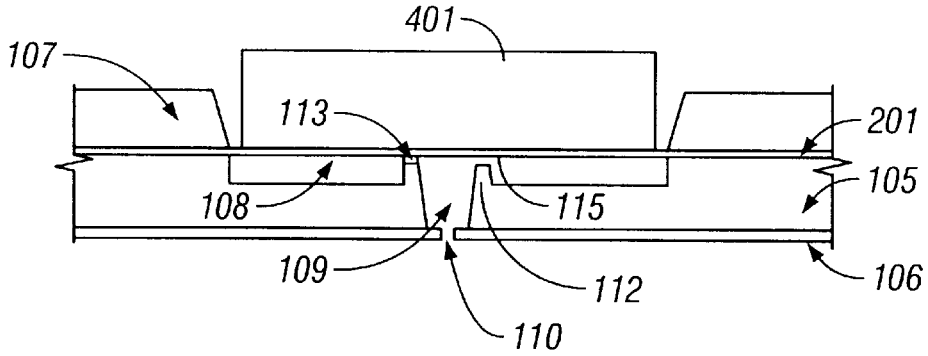
FIGS. 31(*a*)–31(*b*) is a view showing a liquid injection device according to a twenty-second embodiment of the present invention.
Figure 31B:
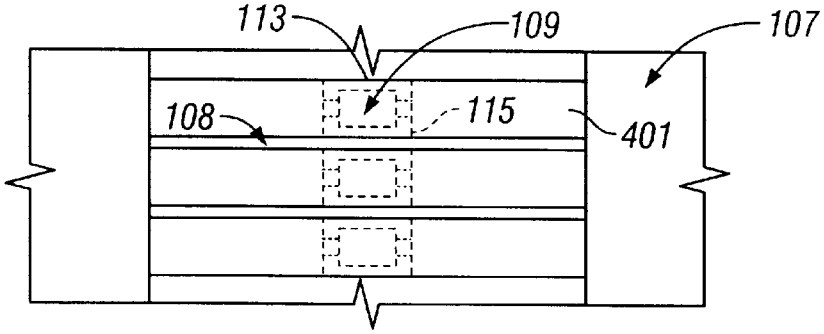

The description will be made of a twenty-second embodiment of a liquid injection device according to the present invention with reference to FIG. 31. In the present embodiment, unlike the twentieth embodiment, an electromagnetic actuator is used as liquid pressurizing means.

Next, the description will be made of the structure and dimensions of the liquid injection device according to the present embodiment. An electromagnetic actuator 401 and a stainless steel substrate 402 are bonded together with adhesive. The stainless steel substrate 402 has 2 $\mu$m in thickness. The stainless steel substrate 402 is fixed to a portion of the partitioning portion 112 in the liquid pressurizing chamber other than a liquid supply port 115 through a low-rigidity layer 113. The thickness and rigidity of the low-rigidity layer 113 are the same as in the first embodiment. The electromagnetic actuator 401 has a length of 5 mm, and a liquid pressurizing chamber 109 has an outer shape: 200 $\mu$m in length and 600 $\mu$m in width, and an inner shape: 140 $\mu$m in length, 500 $\mu$m in width, and 400 $\mu$m in depth. A liquid passage 108 has 5.5 mm in length and 200 $\mu$m in depth. A substrate 106 for formation of an injection port has a thickness of 80 $\mu$m, and the aperture diameter of the injection port 110 is 90 $\mu$m.

Also, a substrate 105 for formation of a liquid chamber and the substrate 106 for formation of an injection port are bonded together with adhesive.

The injection method in a liquid injection device according to the present embodiment is different only in the pressurizing means, and is basically the same as the twentieth embodiment.

The feature of a liquid injection device according to the present embodiment is that the liquid pressurizing means is replaced with an electromagnetic actuator 401 which is capable of obtaining a stronger pressurizing force and larger displacement than the piezo-electric actuator.

As described above, the present embodiment has the effect that it is very advantageous to inject large liquid drops because the electromagnetic actuator is capable of obtaining a large displacement amount in addition to the effect described in the twentieth embodiment.

Twenty-third Embodiment

Figure 32A:
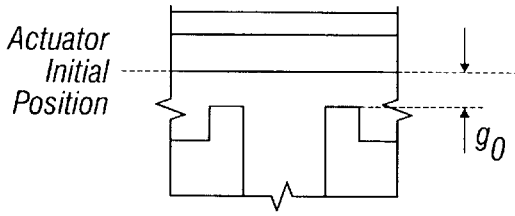
FIGS. 32(*a*)–32(*b*) is a view showing a liquid injection method according to a twenty-third embodiment of the present invention.
Figure 32B:
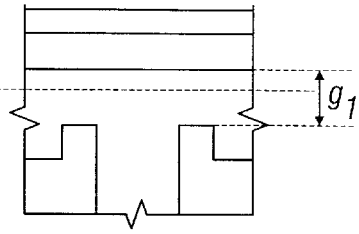
Figure 32C:
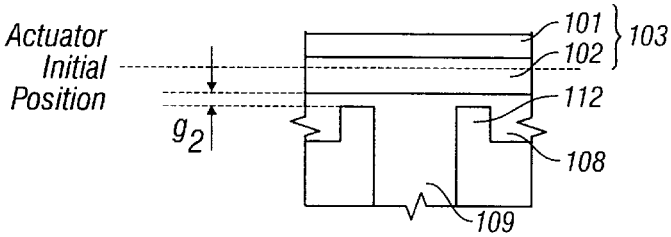

The description will be made of a twenty-third embodiment of a liquid injection device according to the present invention with reference to FIG. 32. The present embodiment relates to an injection method in a liquid injection device having the structure described in, for example, the first or fourth or twentieth embodiment. The detailed description will be made of the liquid injection method on performing dot modulation when the liquid injection device described in the fourth embodiment is used. FIG. 32 is an enlarged view showing the vicinity of a liquid pressurizing chamber 109: FIG. 32(*a*) is a view showing a state when the actuator is at an initial position where it is not in operation; FIG. 32(*b*) is a view showing a state when the piezo-electric actuator 103 is displaced in such a direction as to retract from a partitioning portion 112 in a liquid pressurizing chamber; and FIG. 32(*c*) is a view showing a state when the piezo-electric actuator 103 is brought closest to the partitioning portion 112 in the liquid pressurizing chamber. However, the resin sheet 104 is omitted, and actually, the initial interval g0 is a distance between the lowest portion of the resin sheet 104 and the highest portion of the partitioning portion 112 in the liquid pressurizing chamber. So with the minimum interval g1 or g2. Also, in a state in which the piezo-electric actuator 103 is displaced as shown in FIG. 32(*b*) or FIG. 32(*c*), the piezo-electric actuator 103 actually becomes deformed at a certain curvature, but it is not shown in the figures.

Hereinafter, the detailed description will be made of the liquid injection method according to the present invention. In an initial state, the piezo-electric actuator 103 is at a predetermined position at an initial interval g0 (FIG. 32(*a*)). Next, the piezo-electric actuator 103 is caused to become displaced is caused to become displaced in such a direction as to retract from the partitioning portion 112 in the liquid pressurizing chamber (FIG. 32(*b*), interval g=g1). At this time, the liquid flows from the liquid passage 108 into the liquid pressurizing chamber 109. Further, when the piezo-electric actuator 103 is caused to become displaced in such a direction as to approach the partitioning portion 112 in the liquid pressurizing chamber, the pressure within the liquid pressurizing chamber 109 gradually rises and substantially reaches a maximum in a state (FIG. 32(*c*), interval g=g2),in which the piezo-electric actuator 103 is brought closest to the partitioning portion 112 in the liquid pressurizing chamber. In this state, or before and after this, the liquid is injected through the liquid injection port 110. Here, naturally g1>g0>g2.

The feature of the liquid injection method according to the present invention is that the piezo-electric actuator 103 is caused to become displaced in such a direction as to retract from the partitioning portion 112 in the liquid pressurizing chamber before injection. This feature provides the following effects. Firstly, even when air bubbles or the like are mixed or supplying of the liquid is not in time during a high-speed operation, it becomes possible to smoothly supply the liquid by the liquid pressurizing chamber. Secondly, it becomes possible to effectively enhance the actual displacement amount of the piezo-electric actuator 103, and the modulation width is widened. Thirdly, the change width of the pressure becomes larger to widen the modulation width. This is because in FIG. 32(*b*), the pressure within the liquid pressurizing chamber 109 becomes lower than in the state of FIG. 32(*a*). Through the addition of the injection method according to the present embodiment to, for example, the fourteenth or fifteenth embodiment, the modulation width is increased by 1.2 to 1.5 times.

Through the use of the liquid injection method according to the present embodiment as described above, the modulation width is widened, and it becomes possible to perform finer multi-tone printing and also high-speed printing.

Twenty-fourth Embodiment

Figure 33A:
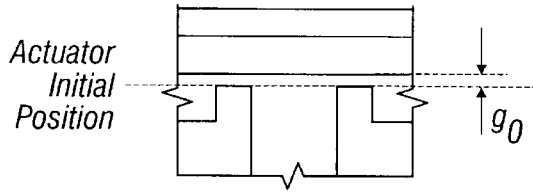
FIGS. 33(*a*)–33(*b*) is a view showing a liquid injection method according to a twenty-fourth embodiment of the present, invention.
Figure 33B:
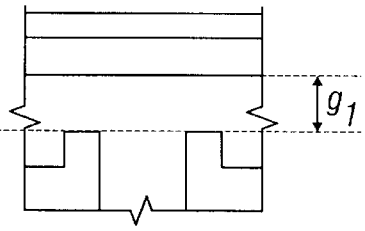
Figure 33C:
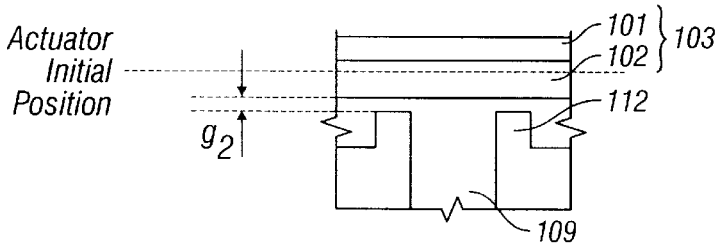

The description will be made of a twenty-fourth embodiment of a liquid injection device according to the present invention with reference to FIG. 33. FIGS. 33(*a*), 33(*b*) and 33(*c*) are generally the same as the states during an injection operation described in the twenty-third embodiment respectively. The liquid injection method according to the present embodiment is the same as in the twenty-third embodiment in that the piezo-electric actuator 103 is once caused to become displaced in such a direction as to retract from the partitioning portion 112 in the liquid pressurizing chamber ($g0<g1$), but is different in that $g0 \approx g2$. This enables the pressure within the liquid pressurizing chamber 109 to be abruptly changed while reducing the actual displacement $\xi r$ of the piezo-electric actuator 103, and it becomes possible to inject very small liquid drops.

In this respect, in the present embodiment, it has been decided that $g0 \approx g2$, but actually, g0 becomes somewhat larger than g2 due to inertia of the piezo-electric actuator 103. This degree varies depending upon the driving speed, shape and the like of the piezo-electric actuator 103, and the value of ($g0-g2$) is approximately less than about 20% of the actual displacement amount $\xi r$.

In this respect, in the first to twenty-second embodiments described above, a stainless steel substrate has mainly been used as the diaphragm 102, but the similar effect can be obtained even if another metallic substrate is used. Also, even when no metallic substrate is used, conductive material is interposed between the piezo-electric substrate 101 and the diaphragm 102, whereby the structure can be arranged so as to obtain the similar effect.

In this respect, in the first to eleventh, and thirteenth to twenty-first embodiments described above, an unimorph actuator or bimorph actuator, which is a piezo-electric actuator of a flexing vibration mode, has been used as the liquid pressurizing member, but a multi-morph actuator comprising a plurality of bimorph actuators stacked may be used. Through the use of this multi-morph actuator, if of the similar outer shape, the displacement amount to be obtained is further increased, and further excellent large displacement properties can be obtained.

Also, in the first to twenty-first, twenty-third and twenty-fourth embodiments described above, a piezo-electric actuator has been used as the liquid pressurizing member, but the similar effect can be obtained even when an actuator which is driven based on another principle of driving such as an actuator using an electromagnetic force is used. In this respect, in the first to twenty-fourth embodiments described above, a liquid injection device comprising a plurality of liquid injection elements lined has been used, but the number of liquid injection elements is not limited thereto, and the similar effect can be obtained if there is at least one.

Also, in the eighth, ninth and thirteenth embodiments described above, single-crystal lithium niobate has been used as a single-crystal piezo-electric element, but the similar effect can be obtained by selecting the cutting angle even if single-crystal material such as lithium tantalic acid and potassium niobate is used. Also, a cutting angle for the lithium niobate is also not limited to 140° y cut, but the similar effect can be obtained even if another cutting angle is used in accordance with a desired property.

Comparative Example

Figure 20A:
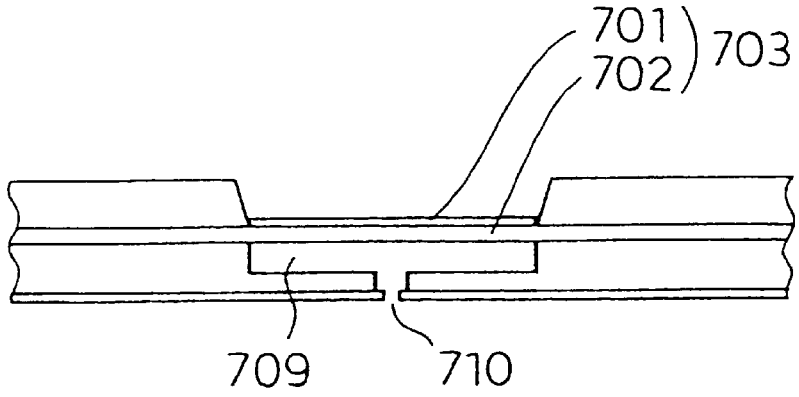
FIGS. 20(*a*)–20(*b*) is a view showing a liquid injection device of a comparative example.
Figure 20B:
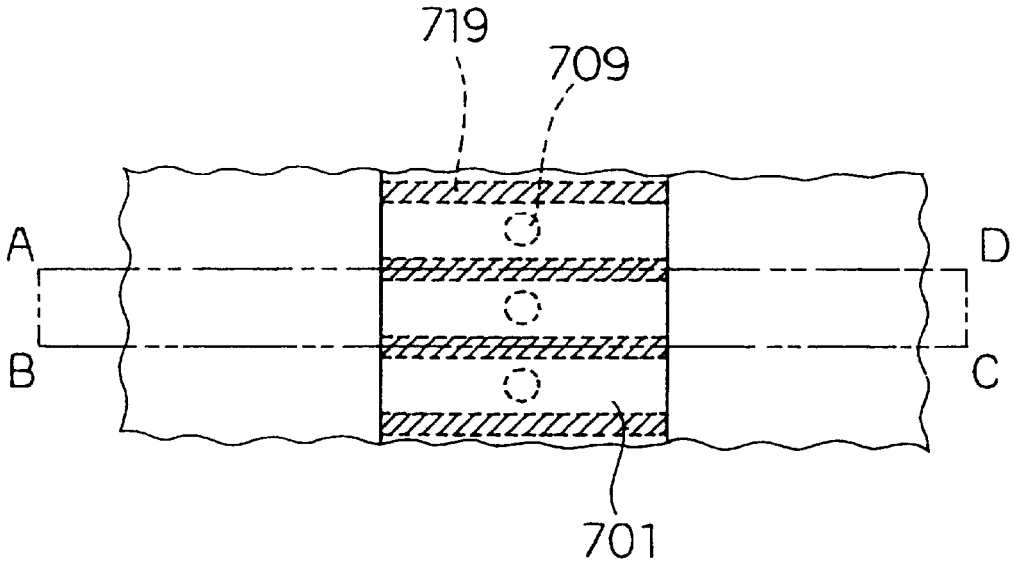

The description will be made of a comparative example with a liquid injection device according to an embodiment of the present invention with reference to FIG. 20.

The present comparative example verifies the characteristic properties of a normal piezo-electric type liquid injection device. In FIG. 20, a reference numeral 701 denotes a piezo-electric substrate, and its thickness and length are the same as those of the piezo-electric substrate 101 in the fourth and tenth embodiments. Also, the piezo-electric substrate 701 is, unlike the piezo-electric substrate 101 in the fourth and tenth embodiments, not separated in the width-wise direction for each element adjacent, but is held over the entire circumference of the piezo-electric substrate 701. More specifically, although it is naturally fixed at its both ends, it is fixed to the lower substrate even in the hatched portion in FIG. 20(*b*). The actuator portion of a diaphragm 702 has also the same thickness and length as the diaphragm 102, and the piezo-electric substrate 701 and the diaphragm 702 are bonded together with adhesive to form a piezo-electric actuator 703. The interval of elements adjacent is about 79 $\mu$m, which is also the same as in the liquid injection device in the fourth and tenth embodiments. A liquid pressurizing chamber 709 has a length of 2 mm and a depth of 200 $\mu$m. The aperture of an injection port 710 has the same size as the injection port 110 in the fourth and tenth embodiments.

In the present comparative example, the cross-sectional area of the pressurizing chamber 709 is equal to the area of the piezo-electric actuator 703. Also, in the present. comparative example, the piezo-electric actuator 703 is fixed to a partitioning 719 constituting the pressurizing chamber 709.

When an injection experiment for the liquid was conducted by using the liquid injection device according to the present comparative example, the number of controllable gradation levels was 2 to about 4 value. However, the upper limit of the amplitude value of the voltage to be applied was set to Vmax.

As will be apparent from the above description, through the use of the structure and injection method in a liquid injection device according to the present invention, it becomes possible to improve the energy utilization efficiency, to operate the liquid pressurizing member in large displacement, to improve the response characteristic of pressure within the liquid pressurizing chamber, and further to provide a device having excellent controllability. Accordingly, it becomes possible to accurately inject liquid drops having a wide range of sizes, and both modulation width and number of gradation levels become larger. Therefore, multi-tone printing can be implemented.

Also, through the use of the manufacturing method for a liquid injection device according to the present embodiment, it is also possible to provide a low-priced, high-performance liquid injection device.

As described above, the present invention relates to a liquid injection device for pressurizing liquid by operating movable members and utilizing its pressure to inject the liquid, a liquid injection method, and a manufacturing method for the liquid injection device. Also, naturally, a liquid injection element as a single unit constituting a liquid injection device, or a liquid injection set comprising the liquid injection device including surrounding members also falls under the category.

The present invention may be used in combination with not only a general ink jet printer, but also equipment provided with printing equipment such as a facsimile, a word processor and a register. Also, it can be also applied as a device to be used in the manufacturing line such as marking and painting on industrial goods, and application of a medical fluid. In addition, as a recording medium for the present invention, metal, glass, resin, earthenware, timber, cloth, hide and the like as well as paper can be used.

What is claimed is:

1. A liquid injection device, comprising:

a liquid pressurizing chamber having one or a plurality of apertures;

a liquid injection port provided at a part of said liquid pressurizing chamber;

a liquid pressurizing member arranged adjacent said liquid pressurizing chamber; and a liquid passage arranged adjacent said liquid pressurizing chamber, within said aperture, a peripheral edge portion of said aperture located at a position opposite to said liquid pressurizing member, and said liquid pressurizing member being arranged to be apart from each other at a gap with a predetermined size when said liquid pressurizing member is driving or even at a non-driving time; and liquid being injected through said liquid injection port by driving said liquid pressurizing member to thereby pressurize said liquid supplied from said liquid passage into said liquid pressurizing chamber;

wherein said gap has such a degree of appropriate size that when said liquid pressurizing member pressurizes and becomes deformed, the gap becomes smaller than an initial size thereof such that liquid within said liquid pressurizing chamber can be prevented from flowing backwards to said liquid passage, and that when said liquid pressurizing member returns to its original state, the gap returns to its initial size such that an adequate amount of said liquid can flow from said liquid passage toward said liquid pressurizing chamber;

further wherein an area of the cross-section of said liquid pressurizing chamber having a displacement direction of said liquid pressurizing member as the direction of a normal thereto is smaller than an area of said liquid pressurizing member;

further wherein said liquid pressurizing member is fixed at both end portions thereof to portions other than partitioning constituting said liquid pressurizing chamber; and further wherein the liquid pressurizing member has a major vibration mode having such a structure to take a lengthwise vibration mode.

2. The liquid injection device according to claim 1, wherein there exists a plurality of said apertures, and an aperture which is not arranged to oppose said liquid pressurizing member is small to such a degree as not to hinder a pressurizing operation when said liquid pressurizing member pressurizes and becomes deformed.

3. The liquid injection device according to claim 1, wherein rigidity of said liquid pressurizing member in the vicinity of a part, to which said liquid pressurizing member is fixed, is lower than that of said liquid pressurizing member in other than the vicinity of said part fixed.

4. The liquid injection device according to claim 1, wherein said area of the cross-section of said liquid pressurizing chamber having a displacement direction of said liquid pressurizing member as the direction of a normal thereto is smaller than an area of a displacement portion of said liquid pressurizing member.

5. The liquid injection device according to claim 4, wherein rigidity of said liquid pressurizing member right above said liquid pressurizing chamber is higher than that of said liquid pressurizing member in any portions other than right above said liquid pressurizing chamber.

6. The liquid injection device according to claim 4, wherein an area S1 of the cross-section of said liquid pressurizing chamber having the displacement direction of said liquid pressurizing member as the direction of the normal thereto, and an area S2 of the cross-section of said liquid pressurizing member satisfy a relation of S2/S1 >5.

7. The liquid injection device according to claim 1, wherein there is arranged a member which isolates said liquid pressurizing member from said liquid, and which is made of material of lower coefficient of elasticity than material constituting said liquid pressurizing member.

8. The liquid injection device according to claim 1, wherein said liquid pressurizing member is a piezo-electric actuator.

9. The liquid injection device according to claim 8, wherein said piezo-electric actuator has a bimorph structure which takes a flexing vibration mode, or a monomorph structure or an unimorph structure.

10. The liquid injection device according to claim 8, wherein piezo-electric material constituting said piezo-electric actuator is piezo-electric ceramic material.

11. The liquid injection device according to claim 8, wherein piezo-electric material constituting said piezo-electric actuator is piezo-electric single-crystal material.

12. The liquid injection device according to claim 11, wherein said piezo-electric actuator has an unimorph structure configured by a diaphragm for setting vibration of a piezo-electric single-crystal substrate in the lengthwise direction to flexing vibration, and said piezo-electric single-crystal substrate and said diaphragm are directly joined.

13. The liquid injection device according to claim 12, wherein said piezo-electric actuator has a bimorph structure configured by at least two piezo-electric single-crystal substrates, and said piezo-electric single-crystal substrates are directly joined with polarization reversed.

14. The liquid injection device according to claim 1, wherein said liquid pressurizing chamber has one or a plurality of apertures, and within said aperture, the entire or a part of the peripheral edge portion of the aperture located at a position opposite to said liquid pressurizing member is in contact with the underside of said liquid pressurizing member through a predetermined member.

15. The liquid injection device according to claim 14, wherein said predetermined member is a member made of material with lower coefficient of elasticity than the material constituting said liquid pressurizing member.

16. The liquid injection method for injecting liquid using the liquid injection device of claim 15, comprising the steps of:

driving said liquid pressurizing member to thereby cause an intervening member having lower rigidity than said liquid pressurizing member to become deformed; and changing the actual volume of said liquid pressurizing chamber to thereby pressurize the liquid within said liquid pressurizing chamber to inject said liquid through said liquid injection port.

17. The liquid injection method in a liquid injection device, comprising:

a liquid pressurizing chamber having one or a plurality of apertures;

a liquid injection port provided at a part of said liquid pressurizing chamber;

a liquid pressurizing member arranged adjacent said liquid pressurizing chamber; and a liquid passage arranged adjacent said liquid pressurizing chamber, within said aperture, a peripheral edge portion of said aperture located at a position opposite to said liquid pressurizing member, and said liquid pressurizing member being arranged to be apart from each other at a gap with a predetermined size; and pressurizing the liquid within said liquid pressurizing chamber to inject said liquid through said liquid injection port by driving said liquid pressurizing member to thereby displace said liquid pressurizing member in such a direction as to change said gap between said liquid pressurizing member and the peripheral edge portion of said aperture;

wherein in a state in which said liquid pressurizing member is displaced so that said liquid pressurizing member is brought closest to said peripheral edge portion of said aperture, assuming, as A1, a value obtained by integrating the pressure generated in said liquid passage for supplying said liquid into said liquid pressurizing chamber with respect to an area of said liquid pressurizing member in contact with said liquid passage, and assuming, as A2, a value obtained by integrating the pressure generated in said liquid pressurizing chamber with respect to an area of said liquid pressurizing member in contact with said liquid pressurizing chamber, a relation of $A2/A1>½$ is satisfied.

18. The liquid injection method according to claim 17, wherein said liquid is injected through said liquid injection port by displacing said liquid pressurizing member in such a direction as to enlarge a gap between said liquid pressurizing member and a peripheral edge portion of said aperture, and subsequently by displacing said liquid pressurizing member in such a direction as to reduce the gap between said liquid pressurizing member and the peripheral edge portion of said aperture.

19. The liquid injection method according to claim 17, wherein an amount of liquid to be injected is controlled by controlling a difference between a distance between said liquid pressurizing member and the peripheral edge portion of said aperture in a state in which said liquid pressurizing member is not displaced, and a distance between said liquid pressurizing member and said peripheral edge portion in a state in which said liquid pressurizing member is displaced so that said liquid pressurizing member is brought closest to said peripheral edge portion of said aperture.

20. The liquid injection method according to claim 17, wherein when a distance g0 between said liquid pressurizing member and the peripheral edge portion of said aperture in a state in which said liquid pressurizing member is not displaced, is larger than a predetermined value as compared with a displacement distance ξf before said liquid pressurizing member is driven, an amount of liquid to be injected is controlled by controlling a difference (g0−ξf between said displacement distance If and said distance g0.

21. The liquid injection method according to claim 17, wherein an amount of liquid to be injected is controlled by controlling a period of time from a time at which said liquid pressurizing member is started to be displaced in such a direction as to reduce a distance between said liquid pressurizing member and said peripheral edge portion of said aperture to a time at which said liquid pressurizing member is brought closest to said peripheral edge portion.

22. The liquid injection method according to claim 17, wherein in a state in which said liquid pressurizing member is not displaced, pressure within said liquid pressurizing chamber and pressure in said liquid passage are equal to each other, while in a state in which said liquid pressurizing member is displaced so that said liquid pressurizing member is brought closest to said peripheral edge portion of said aperture, said pressure within said liquid pressurizing chamber becomes more than five times as high as said pressure within said liquid passage.

23. The liquid injection method according to claim 17, wherein in a piezo-electric actuator, which is displaced by the application of voltage by said liquid pressurizing member, in addition to predetermined driving voltage for driving said piezo-electric actuator, DC voltage is applied at a bias at least at the time-of said driving, and a position of said liquid pressurizing member during driving is adjusted by said DC voltage.

24. The liquid injection method according to claim 17, wherein in a piezo-electric actuator, which is displaced by the application of voltage by said liquid pressurizing member, in addition to predetermined driving voltage for driving said piezo-electric actuator, DC voltage is applied as bias at least at the time of said driving, and a position of said liquid pressurizing member during driving is adjusted by said DC voltage.

25. The liquid injection method according to claim 17, wherein there is adjusted an amount of a predetermined gap between said liquid pressurizing member and the peripheral edge portion of said aperture in a state in which said liquid pressurizing member is not displaced, whereby an initial position of said liquid pressurizing member before driving is set.

26. The liquid injection method according to claim 17, wherein in a piezo-electric actuator, which is displaced by the application of voltage by said liquid pressurizing member, in addition to predetermined driving voltage for driving said piezo-electric actuator under pressure and for driving under reduced pressure, DC voltage is applied as bias to adjust an initial position of said liquid pressurizing member before the driving through said DC voltage.

27. The liquid injection method according to claim 17, wherein said liquid pressurizing member takes a flexing vibration mode.

28. The liquid injection method according to claim 17, wherein said liquid pressurizing member takes a lengthwise vibration mode.

29. A liquid injection device, comprising:

a liquid pressurizing chamber having a plurality of apertures;

a liquid injection port provided at a part of said liquid pressurizing chamber;

a liquid pressurizing member arranged adjacent said liquid pressurizing chamber; and a liquid passage arranged adjacent said liquid pressurizing chamber, within at least one of said apertures, a peripheral edge portion of said at least one aperture located at a position opposite to said liquid pressurizing member, and said liquid pressurizing,member being arranged to be apart from each other at a gap with a predetermined size when said liquid pressurizing member is driving or even at a non-driving time; wherein at least one of said apertures is not arranged to oppose said liquid pressurizing member and is small to such a degree as not to hinder a pressurizing operation when said liquid pressurizing member pressurizes and becomes deformed; and liquid being injected through said liquid injection port by driving said liquid pressurizing member to thereby pressurize said liquid supplied from said liquid passage into said liquid pressurizing chamber;

wherein said gap has such a degree of appropriate size that when said liquid pressurizing member pressurizes and becomes deformed, the gap becomes smaller than an initial size thereof such that liquid within said liquid pressurizing chamber can be prevented from flowing backwards to said liquid passage, and that when said liquid pressurizing member returns to its original state, the gap returns to its initial size such that an adequate amount of said liquid can flow from said liquid passage toward said liquid pressurizing chamber;

further wherein said liquid pressurizing member is fixed at both end portions thereof to portions other than partitioning constituting said liquid pressurizing chamber; and further wherein the liquid pressurizing member has a major vibration mode having such a structure to take a lengthwise vibration mode.

* * * * *

UNITED STATES PATENT AND TRADEMARK OFFICE

CERTIFICATE OF CORRECTION

PATENT NO. : 6,497,476 B1
DATED : April 14, 2003
INVENTOR(S) : Akihiko Namba et al.

It is certified that error appears in the above-identified patent and that said Letters Patent is hereby corrected as shown below:

Title page,
Item [75], Inventors, replace "Yosihiro Tomita" with -- Yoshihiro Tomita --

Signed and Sealed this

Tenth Day of June, 2003

JAMES E. ROGAN
*Director of the United States Patent and Trademark Office*